US006956555B2

(12) United States Patent
Kyomoto

(10) Patent No.: US 6,956,555 B2
(45) Date of Patent: Oct. 18, 2005

(54) LIGHT MODULATION INFORMATION DISPLAY DEVICE AND ILLUMINATION CONTROL DEVICE

(75) Inventor: Tadao Kyomoto, Matsudo (JP)

(73) Assignee: Sharp Kabushiki Kaisha, Osaka (JP)

( * ) Notice: Subject to any disclaimer, the term of this patent is extended or adjusted under 35 U.S.C. 154(b) by 498 days.

(21) Appl. No.: 09/845,559

(22) Filed: Apr. 30, 2001

(65) Prior Publication Data

US 2002/0018053 A1 Feb. 14, 2002

(30) Foreign Application Priority Data

May 2, 2000 (JP) ..... 2000-134000
May 23, 2000 (JP) ..... 2000-152206

(51) Int. Cl.[7] ..... G09G 3/36
(52) U.S. Cl. ..... 345/102; 345/204
(58) Field of Search ..... 345/102, 204, 345/690; 349/61, 62, 63; 362/27, 29, 30, 260; 315/169.3

(56) References Cited

U.S. PATENT DOCUMENTS 5,237,241 A * 8/1993 Hashimoto ..... 315/60
5,461,397 A * 10/1995 Zhang et al. ..... 345/102
6,657,607 B1 * 12/2003 Evanicky et al. ..... 345/102

FOREIGN PATENT DOCUMENTS

| | | |
|---|---|---|
| JP | 3198026 | 8/1991 |
| JP | 4342951 | 11/1992 |
| JP | 4-342951 | 11/1992 |
| JP | 11-297485 | 10/1999 |

* cited by examiner

*Primary Examiner*—Chanh Nguyen
(74) *Attorney, Agent, or Firm*—Edwards & Angell, LLP; David G. Conlin, Esq.; George N. Chachlas

(57) ABSTRACT

An illumination control device for illuminating an light modulation information display device with light includes: at least one illumination device for irradiating light which is generated through discharging; and a driving waveform generation section for controlling the light which is irradiated from the at least one illumination device to the light modulation information display device. The light modulation information display device is operable so as to have a first period and a second period during which an image is displayed. During the first period, the driving waveform generation section applies a first voltage to the at least one illumination device, the first voltage causing the at least one illumination device to be turned entirely-ON. During the second period, the driving waveform generation section applies a second voltage to at least a portion of the at least one illumination device.

16 Claims, 15 Drawing Sheets

Prior Art

Prior Art

LIGHT MODULATION INFORMATION DISPLAY DEVICE AND ILLUMINATION CONTROL DEVICE

BACKGROUND OF THE INVENTION

1. Field of the Invention

The present invention relates to a light modulation information display device (hereinafter referred to as an "LM information display device") which displays information through variable control of the transmission, absorption, interception, reflection state or reflection direction of light, and an illumination control device for controlling an illumination device which is provided on a back face or a front face of a display section of an LM information display device. In particular, the present invention relates to an LM information display device and an illumination control device which can provide improved power consumption and improved display quality for moving pictures, and higher reliability. Moreover, the present invention relates particularly to: an LM information display device which can be suitably used as a liquid crystal display device for displaying moving pictures or the like; and an illumination control device which is used as a backlight control device for controlling a backlight provided on a back face of a display section of such an LM information display device, or as a frontlight control device for controlling a frontlight provided on a front face of such an LM information display device, and which can achieve optimum ON/OFF control for a fluorescence discharge tube, e.g., a cold-cathode fluorescence discharge tube.

2. Description of the Related Art

An LM information display device which incorporates an illumination device and an illumination control device for controlling the illumination device can have various structures. Examples of such LM information display devices include underlying-type backlight LM information display devices and side-type backlight LM information display devices. Such classification is based on the positioning of the illumination device.

In the field of transmission liquid crystal display devices, which are exemplary of LM information display device currently in use, it is commonplace to employ an underlying-type backlight LM information display device in order to improve the display uniformity. This is especially the case with large-size transmission liquid crystal display devices (i.e., of a size designated as "20" or higher) for displaying moving pictures. Hereinafter, as Conventional Example 1, an example of a conventional underlying-type backlight LM information display device and a conventional side-type backlight LM information display device will be described.

FIG. 20 schematically shows a conventional underlying-type backlight LM information display device 2000. The underlying-type backlight LM information display device 2000 includes an LM information display section 2001, illumination devices (fluorescence discharge tube) 2003 and 2014, and a light guide layer 2002 for guiding illumination light emitted from the fluorescence discharge tubes 2003 and 2014 into the LM information display section 2001.

In the underlying-type backlight LM information display device 2000, the fluorescence discharge tubes 2003 and 2014 are provided directly under the light guide layer 2002, so that the underlying-type backlight LM information display device 2000 itself may have a relatively large depth. However, the thickness of the underlying-type backlight LM information display device 2000 does not increase with an increase in the number of fluorescence discharge tubes 2003 and 2014. Moreover, the underlying-type backlight LM information display device 2000 provides a greater flexibility as to the number and arrangement of fluorescence discharge tubes 2003 and 2014 to be employed than a side-type backlight LM information display device.

FIG. 21 schematically shows a conventional side-type backlight LM information display device 2100. The side-type backlight LM information display device 2100 includes an LM information display section 2111, a light guide layer 2112 for guiding light into the LM information display section 2111, lamp reflectors 2116*a* for deflecting the light toward the light guide layer 2112, and at least one fluorescence discharge tube 2116 which is partially surrounded by the lamp reflector 2116*a*. Although the lamp reflectors 2116*a* and the fluorescence discharge tubes 2116 are illustrated as being provided on both sides of the light guide layer 2112 in the side-type backlight LM information display device 2100 of FIG. 21, a lamp reflector 2116*a* and a fluorescence discharge tube 2116 may be provided on only one side of the light guide layer 2112.

In the case where the above side-type backlight LM information display device is employed for a large-size display devices for displaying moving pictures, it is commonplace to increase the number of fluorescence discharge tubes 2116 to be provided on either side or both sides in order to obtain improved luminance and to alleviate luminance unevenness. In this case, however, the size of the display device 2100 itself increases in proportion with the number of fluorescence discharge tubes 2116 employed.

In general, a backlight control device is controlled so as to be always ON in the following manner. A DC rated voltage is input to an inverter circuit, and a high step-up ratio is obtained by means of a piezoelectric transformer at the beginning of the discharging in order to begin discharging of the fluorescence discharge tubes. Once discharging is begun and the impedance of the fluorescence discharge tube has lowered, a stable voltage is obtained by means of a winding transformer so as to maintain the fluorescence discharge tube to be ON.

In recent years, it has been discovered through line-of-sight tracing tests that display blurs, e.g., blurred outlines, occur with a hold-type emission display method (as used in liquid crystal display devices, etc.), as opposed to an impulse-type emission display method (as used in CRTs (cathode ray tubes), etc.), thereby detracting from the display quality when displaying moving pictures.

FIG. 22A shows results of line-of-sight tracing with respect to a hold-type emission display method. In FIG. 22A, the axis of ordinates represents time, where one resolution unit is equal to 1/60 sec, which corresponds to 1 frame period; and the axis of abscissas represent the positions of pixels.

In this case, since the illumination device is always ON during 1 frame period, a viewer's eyes will try to follow a movement in the display with a locus as indicated by the broken lines in FIG. 22A. As a result, the viewer will see an image in accordance with an integral of the luminance values and relative positions along the broken lines. Therefore, the viewer cannot capture the proper gray-scale images (portions indicated in black), but instead sees an image which is a combination of the proper gray-scale images and any gray-scale values (portions indicated in dots) adjoining the outline. Such portions contribute to so-called blurred outlines.

One conventional approach for improving such display blurs involves the use of ON periods and OFF periods within 1 frame period, in an attempt to realize a CRT-like impulse-type emission display method.

FIG. 22B shows results of line-of-sight tracing with respect to a case where ON periods and OFF periods are present within 1 frame period of an illumination device. In this case, during frame transitions, the gray-scale components associated with the adjoining pixels do not contribute to the trace line (indicated by the broken lines) with which the line-of-sight of a viewer follows positions on the outline. As a result, the viewer is prevented from seeing an image having blurred outlines.

In order to implement an impulse-type emission display method in a liquid crystal display device (which is an exemplary LM information display device), it might be possible to operate a display panel of the liquid crystal display device so as to obtain bright or dark images while controlling the fluorescence discharge tubes so as to be always ON. However, obtaining bright or dark images based on the operation of a liquid crystal display device is accompanied by the following problems.

Firstly, an increase in the power consumption in the liquid crystal display device results, thereby detracting from its comparative advantages over other types of display devices (CRTs, PDPs (plasma display panels), etc.). Secondly, since there is an increased number of fluorescence discharge tubes with a high density, the temperature of the fluorescence discharge tubes may increase as a result of controlling the fluorescence discharge tubes so as to be always ON, resulting in a decrease in display contrast. Thirdly, there is a problem associated with the response speed, which is dependent on the particular liquid crystal material used: outstanding display blurs (e.g., blurred outlines) and residual images will occur when moving pictures are displayed at a fast rate.

Another possible method for implementing an impulse-type emission display method in a liquid crystal display device involves flickering a fluorescence discharge tube(s) composing a backlight. The following conventional backlight control device structures for controlling such a backlight have been proposed. For example, Japanese Laid-Open Publication No. 3-198026 (filed by Hitachi, Ltd.) adopts a technique of "splitting a backlight into a plurality of regions, such that the split regions can be controlled so as to flicker and/or have controlled luminance in a distinguishable manner". Japanese Laid-Open Publication No. 11-297485 (Sony Corporation) adopts a technique of "inactivating an inverter circuit during a blanking period of an image signal so as to turn off fluorescence discharge tubes used as a backlight".

Referring to FIG. 20, it will be described how such conventional techniques can be implemented in the operation of the aforementioned conventional LM information display device 2000 (which is an underlying-type backlight LM information display device). The light guide layer 2002 is split into a plurality of regions, and the fluorescence discharge tubes 2003 and 2014 are provided on the back face of the light guide layer 2002 so as to correspond to the respective split regions of the light guide layer 2002. The fluorescence discharge tubes 2003 and 2014 are configured so as to be capable of flickering (or having controlled luminance) simultaneously or individually for the respective split regions. The fluorescence discharge tube 2003 (indicated in white) represents a fluorescence discharge tube which is ON (or has a high luminance), whereas the fluorescence discharge tubes 2014 (indicated in black) represent fluorescence discharge tubes which are OFF (or have a low luminance).

The aforementioned conventional examples can be commonly characterized in that, instead of turning all of the fluorescence discharge tubes ON or OFF, illumination devices (fluorescence discharge tubes) are controllable so as to be individually turned ON or OFF or have their light amounts regulated (bright or dark) based on an image signal for the display device, thereby improving the power consumption of the device.

In the aforementioned Conventional Example 1, cold-cathode fluorescence discharge tubes are used as fluorescence discharge tubes. Since the electrode structure in cold-cathode fluorescence discharge tubes does not require a filament transformer mechanism, unlike the electrode structure in hot-cathode discharge tubes, cold-cathode fluorescence discharge tubes are advantageous in terms of power consumption, device life/reliability, and down-sizing. Hence, cold-cathode fluorescence discharge tubes are employed as illumination devices in many liquid crystal display devices.

The electrode structure in a conventional cold-cathode fluorescence discharge tube is essentially a two-terminal discharge tube structure. The ON/OFF control of the cold-cathode fluorescence discharge tube is performed via an inverter circuit in a such a manner that a DC voltage is stepped up at the beginning of the discharging by means of a step-up means so as to instantaneously generate a discharge starting voltage for the fluorescence discharge tube. Thereafter, after the impedance of the fluorescence discharge tube has lowered, a stable voltage is generated by means of a winding transformer, whereby the ON state is maintained.

The discharge starting voltage has an excessive voltage component as compared to the ensuing discharging voltage. It is known that, since the amount of electrons which are sputtered increases at the beginning of the discharging, vigorous sputtering occurs in the neighborhood of the electrodes, leading to the blackening of the fluorescent material and the deterioration of the electrodes.

A method for establishing a stabilized discharging has been proposed, which involves the use of cold-cathode fluorescence discharge tubes having a multi-electrode structure (Conventional Example 2). For example, according to Japanese Laid-Open Publication No. 4-342951 (Sony Corporation), an auxiliary electrode is provided in the neighborhood of two main discharging electrodes of a cold-cathode fluorescence discharge tube, so that a potential difference can be obtained between the main discharging electrodes and the auxiliary electrode at the beginning of the discharging. Thus, a stable discharge state can be obtained in a short period of time.

As described above, in transmission liquid crystal display devices, which are exemplary conventional LM information display devices, cold-cathode fluorescence discharge tubes are generally employed from the perspective of power consumption, device life/reliability, and down-sizing, and an always-ON method is used as the ON/OFF control method thereof.

While the aforementioned technique of repeatedly turning ON or OFF the fluorescence discharge tubes as illustrated in Conventional Example 1 does contribute to an improvement in power consumption, it is disadvantageous in terms of the device life of the fluorescence discharge tubes. This is because, at each moment when a fluorescence discharge tube transitions from an OFF state to an ON state, impulse noises such as an undershoot may be added in an inverter circuit which serves as an ON/OFF control circuit for the fluorescence discharge tubes, so that the instantaneous potential difference may exceed the rated input voltage value for the inverter circuit. Consequently, excessive components may be applied to the fluorescence discharge tubes as a discharge starting current and a discharge starting voltage. Thus, the amount of electrons which are sputtered increases at the electrodes of the fluorescence discharge tubes, resulting in a vigorous sputtering and leading to the blackening of the fluorescent material and the deterioration of the electrodes. This shortens the device life of the fluorescence discharge tubes.

Furthermore, in accordance with a light regulation method which repeats transitions between bright/dark states by controlling the luminance of the fluorescence discharge tubes, there can be an improvement in the power consumption of no more than about 20% to 30% (by actual measurement values). This technique also has a problem, among others, in that a substantial increase in temperature occurs in the case where fluorescence discharge tubes are provided close together; when such a high temperature is transmitted to the liquid crystal panel, the display contrast is decreased, undermining the display quality and reliability.

In conventional fluorescence discharge tubes having a multi-electrode structure described in Conventional Example 2, in which an increased number of electrodes are employed in the cold-cathode fluorescence discharge tubes so as to stabilize the initial discharging, strong electron bonds are present between the main discharging electrodes at the beginning of the discharging. As a result, the amount of electrons which are sputtered increases between the auxiliary electrode and the main discharging electrodes, leading to electrode deterioration.

Furthermore, the conventional method in which the interference of image information associated with the adjoining display frames is prevented by flickering the fluorescence discharge tubes during 1 frame period of displaying information in order to improve the display blurs of LM information display devices has a problem in that the number of times that the fluorescence discharge tubes are switched, i.e., the number of times that the discharge starting voltage is applied, increases. As a result, the device life of the fluorescence discharge tubes may drastically deteriorate.

SUMMARY OF THE INVENTION

According to the present invention, there is provided an illumination control device for illuminating an light modulation information display device with light, including: at least one illumination device for irradiating light which is generated through discharging; and a driving waveform generation section for controlling the light which is irradiated from the at least one illumination device to the light modulation information display device, wherein: the light modulation information display device is operable so as to have a first period and a second period during which an image is displayed; during the first period, the driving waveform generation section applies a first voltage to the at least one illumination device, the first voltage causing the at least one illumination device to be turned entirely-ON; and during the second period, the driving waveform generation section applies a second voltage to at least a portion of the at least one illumination device.

In one embodiment of the invention, the second voltage is a partially-ON voltage for causing at least a portion of the at least one illumination device to be illuminated.

In another embodiment of the invention, the second voltage causes the at least one illumination device to have a minimal discharging.

In still another embodiment of the invention, the second voltage causes the at least one illumination device to retain a partial discharging.

In still another embodiment of the invention, each of the at least one illumination device includes two main discharging electrodes and a partial discharging electrode provided in a vicinity of one of the two main discharging electrodes; the driving waveform generation section applies the first voltage between the two main discharging electrodes during the first period; and the driving waveform generation section applies the second voltage between the partial discharging electrode and the one main discharging electrode in the vicinity of the partial discharging electrode during the second period.

In still another embodiment of the invention, the at least one illumination device includes a plurality of illumination devices; and for each of the plurality of illumination devices, the driving waveform generation section individually selects a voltage to be applied and electrodes between which a discharge is to occur, depending on the first period and the second period of the illumination device.

In still another embodiment of the invention, an outer wall of the illumination device includes at least one of a light shielding surface or an ultraviolet ray-shielding surface in a vicinity of a portion between the one discharging electrode and the partial discharging electrode.

In another aspect of the invention, there is provided a light modulation information display device including: any one of the aforementioned illumination control devices; and a light modulation information display section, wherein the light modulation information display section controls light provided from the illumination control device to display information.

In one embodiment of the invention, the controlling of the light includes at least one of transmission, absorption, interception, reflection of the light.

Alternatively, a light modulation information display device according to the present invention includes: a light modulation information display section; and an illumination control device including at least one illumination device having two main discharging electrodes and a partial discharging electrode, wherein light provided from the at least one illumination device is irradiated to the light modulation information display section, wherein: the at least one illumination device has a length greater than a corresponding dimension of the light modulation information display section; the at least one illumination device includes a first region corresponding to the light modulation information display section and a second region not corresponding to the light modulation information display section; and one of the two main discharging electrodes is disposed in the first region, and the other of the two main discharging electrodes and the partial discharging electrode are disposed in the second region.

In still another embodiment of the invention, the at least one illumination device undergoes a partially-ON state between the other of the two main discharging electrodes disposed in the second and the partial discharging electrode.

In still another embodiment of the invention, the at least one illumination device retains a minimal discharging between the other of the two main discharging electrodes disposed in the second region and the partial discharging electrode.

In still another embodiment of the invention, the at least one illumination device retains a partial discharging between the other of the two main discharging electrodes disposed in the second region and the partial discharging electrode.

In still another embodiment of the invention, the light modulation information display section is split into a plurality of split display regions each containing a number of horizontal scanning lines; at least one split activatable region is provided in the illumination control device so as to correspond to each of the plurality of split display regions, wherein at least one illumination device is assigned to each of the plurality of split activatable regions; a voltage is applied between the two main discharging electrodes of at least one illumination device in at least one of the plurality of split activatable regions corresponding to at least one of the plurality of split display regions over which scanning of an image has progressed or completed; and a voltage is applied between the partial discharging electrode and the other of the two main discharging electrodes of at least one illumination device in at least one of the plurality of split activatable regions corresponding to at least one split display region over which scanning of the image has not been performed.

In still another embodiment of the invention, the light modulation information display device further includes a light modulation material; the light modulation information display section is split into a plurality of split display regions each containing a number of horizontal scanning lines; at least one split activatable region is provided in the illumination control device so as to correspond to each of the plurality of split display regions, wherein at least one illumination device is assigned to each of the plurality of split activatable regions; after scanning of an image over at least one of the plurality of split display regions has progressed or completed, with a delay corresponding to a response time of the light modulation material, a voltage is applied between the two main discharging electrodes of at least one illumination device in at least one of the plurality of split activatable regions corresponding to the at least one split display region; and a voltage is applied between the partial discharging electrode and the other of the two main discharging electrodes of at least one illumination device in at least one of the plurality of split activatable regions corresponding to the split display regions over which scanning has not been performed.

In still another embodiment of the invention, the light modulation information display device further includes a light-switching element for controlling the light modulation information display section; and after the scanning has progressed or completed, with a delay corresponding to a response time of the light modulation material and a response time of the light-switching element, a voltage is applied between the two main discharging electrodes of at least one illumination device in the at least one split activatable region corresponding to the at least one split display region.

In still another embodiment of the invention, based on an information displaying signal which is applied to the light modulation information display section during a 1 frame, a voltage is applied between the two main discharging electrodes of the at least one illumination device during an entirely-ON voltage period, a voltage is applied between the partial discharging electrode and the other of the two main discharging electrodes of the at least one illumination device during a partially-ON voltage period or a retention discharging voltage period.

In still another embodiment of the invention, when a period during which the voltage is applied between the other of the two main discharging electrodes and the partial discharging electrode transitions to a period during which the voltage is applied between the two main discharging electrodes, a delay corresponding to a response time of the light modulation material is introduced in the split activatable region after scanning over an image has progressed or completed in the light modulation information display section.

Hereinafter, the functions of the present invention will be described.

According to the present invention, an illumination control device is operated so as to have a period during which an entirely-ON voltage for causing an illumination device to be turned entirely-ON is applied, and a period during which a partially-ON voltage for turning ON only a portion of the illumination device is applied. Alternatively, the illumination control device is operated so as to have a period during which an entirely-ON voltage for causing the illumination device to be turned entirely-ON is applied, and a period during which a retention discharging voltage (non-entirely-ON voltage) for retaining the minimal discharging of the illumination device, or discharging in a portion of the illumination device is applied.

Accordingly, as described later with respect to Example 1 and Example 2, a fluorescence discharge tube serving as the illumination device is not completely turned OFF, so that the excessive voltage components which may be present at the beginning of the discharging can be reduced, and the number of electrons sputtered within the fluorescence discharge tube can be controlled, as compared to the conventional control method which repeats turning ON and OFF. Thus, electrode deterioration and the destruction of the inverter circuit can be prevented, whereby the device life characteristics can be improved.

The activation or discharging is always performed in a partially-ON, minimal discharging retention, or a partial discharging portion of each fluorescence discharge tube serving as an illumination device. Therefore, the temperature in the vicinity of the electrodes can be stabilized, thereby obtaining an electrode temperature which can provide the optimum luminance. Moreover, the present invention can minimize the temperature elevation which may occur when a number of fluorescence discharge tubes are provided at a high density as compared to the conventional light regulation (bright/dark) method. Thus, the deterioration in display quality and reliability can be prevented, and reduced power consumption can be realized.

For example, in the case where a three-electrode structure is employed such that a third electrode is provided in a central portion of a fluorescence discharge tube in addition to a first electrode and a second electrode (discharging electrodes) provided at both ends of the fluorescence discharge tube, a discharging may occur between the first electrode and the second electrode (referred to as "entire discharging" or "entirely-ON discharging") and a discharging may occur between the first electrode and the third electrode (referred to as "partial discharging"). Minimal discharging ("Townsend discharging") may also occur in a portion of the illumination device.

Furthermore, the length of the illumination device is designed so as to be greater than the corresponding dimension of the effective display area of an LM information display section and the corresponding dimension of a light guide layer which is provided on a front face or back face of the LM information display section, and the portion of the illumination device which protrudes outside the effective display area of the LM information display section and the light guide layer may be subjected to a partially-ON state, minimal discharging retention, or partial discharging. As a result, the illumination light from the portion of the fluorescence discharge tube which is partially-ON (or partially discharging) is prevented from reaching the light guide layer or the effective display area of the LM information display section, so that unwanted light does not stray into the non-displaying portions. Consequently, the display quality can be improved as compared with that obtained with the conventional light regulation (bright/dark) method.

The LM information display section is split into a plurality of split display regions each containing a number of horizontal scanning lines, and at least one split activatable region is provided in the illumination control device corresponding to each split display region. At least one illumination device is provided in each split activatable region. An activation state control section is provided which operates so as to ensure that the illumination devices are turned entirely-ON in any split activatable regions corresponding to the split display regions over which scanning has progressed or completed, whereas in any split activatable regions corresponding the split display regions for which scanning has not been performed, only a portion of the illumination device(s) may be turned ON, minimal discharging may be retained, or partial discharging may be retained. As a result, information displaying portions and the non-displaying portions of the light modulation information display section are controlled, display blurs such as blurred outlines associated with line-of-sight tracing and residual images can be alleviated, and moving pictures can be displayed with a high display quality.

The activation state control section may be operated so as to introduce, after scanning has progressed or completed, a delay corresponding to the response times of light-switching elements and/or a light modulation material provided in the LM information display section before causing any illumination devices in the split activatable regions corresponding to the split display regions which have been scanned to be turned entirely-ON, whereas only a portion of the illumination device(s) may be turned ON, minimal discharging may be retained, or partial discharging may be retained in any split activatable regions corresponding to the split display regions which have not been scanned. As a result, display blurs associated with the delayed response of the light-switching elements and/or the light modulation material can be minimized, and a high-quality display of moving pictures can be realized. In this case, two split activatable regions may be provided corresponding to each split display region, for example.

Based on information displaying signals which are applied to the LM information display section during 1 frame, the activation state control section generates an ON/OFF control signal for the illumination device(s) which has a period during which an entirely-ON voltage is applied, and a period during which a partially-ON voltage or a retention discharging voltage is applied. During a period in which an entirely-ON voltage is applied, at least one illumination device is turned entirely-ON. During a period in which a partially-ON voltage or a retention discharging voltage is applied, only a portion of at least one illumination device may be turned ON, minimal discharging may be retained, or partial discharging may be retained.

As a result, it is possible to prevent an increase in the number of times a discharge starting voltage is applied, which may occur when flickering, i.e., repetitions of a complete OFF state and a complete ON (entire discharging) state is performed (as in a conventional illumination device which has been proposed for improving display blurs associated with line-of-sight tracing). Thus, drastic reduction in the device life of the illumination devices (fluorescence discharge tubes) can be prevented.

Furthermore, the length of the illumination device is designed so as to be greater than the corresponding dimension of the effective display area of an LM information display section and the corresponding dimension of a light guide layer which is provided on a front face or back face of the LM information display section, and an activation control section for controlling the illumination devices may be provided on a front face or a back face of the portion of the illumination device which protrudes outside the effective display area of the LM information display section and the light guide layer. As a result, the entire LM information display device can be prevented from having an increased structure size.

According to the present invention, the illumination control device is operated so as to provide an entirely-ON period during which an entirely-ON voltage for causing the illumination device to be turned entirely-ON is applied between two main discharging electrodes of the illumination device, a partially-ON period during which a partially-ON voltage for turning ON only a portion of the illumination device is applied between at least one of the main discharging electrodes and a neighboring partial discharging electrode, or a partial discharging period during which a partially discharging voltage for causing only a portion of the illumination device to discharge is applied. As a result, as described later with respect to Example 1 and Example 2, during 1 frame period, it is possible to flicker the fluorescence discharge tube (illumination device) while sustaining a discharge state. Thus, the number of times a discharge starting voltage is applied can be reduced, thereby preventing the generation of excessive voltage components at the beginning of the discharging, and preventing the deterioration of the fluorescence discharge tube (illumination device).

Furthermore, the outer wall of a portion between a main discharging electrode and the partial discharging electrode of the illumination device may be a light shielding surface or an ultraviolet ray-shielding surface, in which case, during a partial discharging period, electrons which are generated between the main discharging electrode and the partial discharging electrode are prevented from being sputtered into the fluorescent material which is applied on an inner wall of the fluorescence discharge tube. Light leakage during a partial discharging period can be prevented.

The LM information display section is split into a plurality of split display regions each containing a number of horizontal scanning lines, at least one, or two or more split activatable regions may be provided corresponding to each split display region, and at least one illumination device is provided in each split activatable region. By individually controlling the ON/OFF of the illumination device(s) in each split activatable region, display blurs such as outlines associated with line-of-sight tracing or residual images, such as those associated with the conventional always-ON scheme, can be alleviated, and a high-quality display of moving pictures can be realized.

In particular, in the case of a liquid crystal display device, when a partially-ON period or a partial discharging period transitions to an entirely-ON period in each split activatable region, it is preferable to introduce a delay or gain in time corresponding to the response time of the light modulation material, thereby taking into account the response time of the liquid crystal material serving as a light modulation material. As used herein, in the case of a liquid crystal display device, the "light modulation material" refers to a liquid crystal material and a fluorescent material used for the fluorescence discharge tube(s). Not only a liquid crystal material, but also a fluorescent material used for the fluorescence discharge tubes has a specific response speed in emission, and further has a different response for R, G, or B. It is presumable that activating all the colors of R, G, and B with the same timing may result in an inappropriate color balance. For example, in the case where three kinds (i.e., R, G, and B) fluorescence discharge tubes are employed as illumination devices (as opposed to white fluorescence discharge tubes), assuming that the R fluorescence discharge tubes have a relatively slow response, the R fluorescence discharge tubes may be allowed to be turned ON in advance, or the G or B fluorescence discharge tubes may be allowed to be turned ON with some delay, whereby the intended color balance can be conserved.

Thus, the invention described herein makes possible the advantages of: (1) providing an LM (light modulation) information display device and an illumination control device, which realize reduction in the power consumption and improvement in the display quality of moving pictures, improvement in the device life of an illumination device, while preventing the deterioration in display quality or reliability due to elevated temperature; and (2) providing an LM information display device and an illumination control device which can improve the device life of an illumination device and improve the display quality of moving pictures.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of examples, with reference to the accompanying figures.

EXAMPLE 1

Figure 1A:
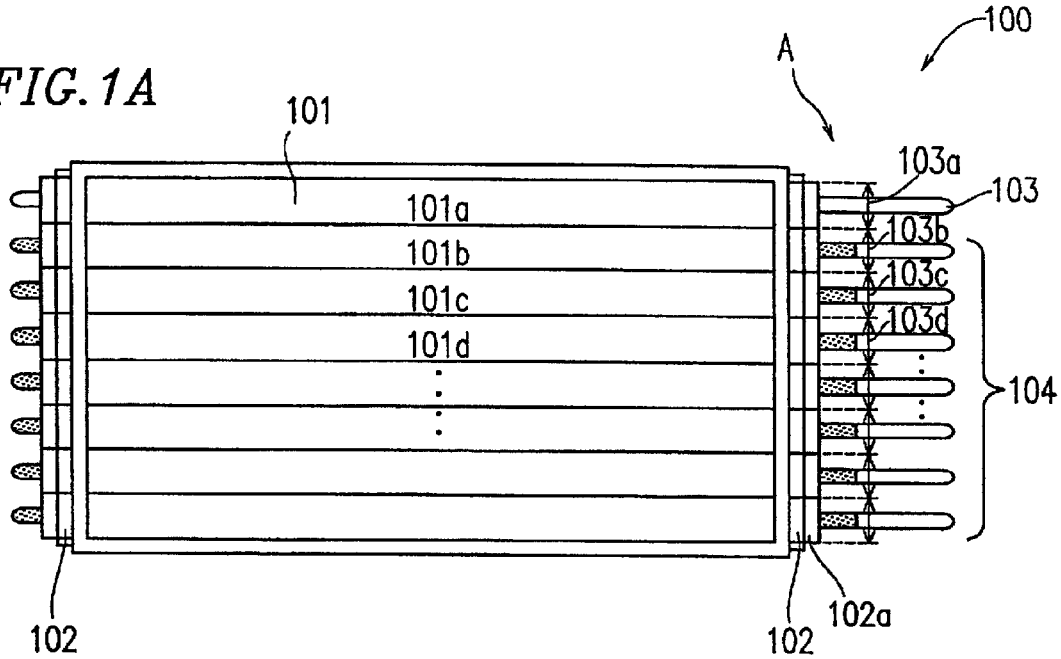
FIG. 1A is a plan view schematically illustrating an underlying-type backlight LM information display device according to Example 1 of the present invention.

FIG. 1A is a plan view schematically illustrating an underlying-type backlight LM information display device 100 according to Example 1 of the present invention.

The LM information display device 100 includes an LM information display section 101, illumination devices 103 and 104, and a light guide layer 102 which is provided on a back face of the LM information display section 101 for guiding the illumination light emitted from the illumination devices 103 and 104 into the LM information display section 101. The illumination devices 103 and 104 are provided directly under the light guide layer 102. The illumination devices 103 and 104 are controlled by an illumination control device which is described later.

In the present example, a liquid crystal panel including TFTs (thin film transistors) serving as light-switching elements is used for the LM information display section 101. As the light guide layer 102, a colorless plate of acrylic resin may be used, and a diffusion sheet and a prism sheet 102*a* maybe provided on an outgoing end thereof. The present example illustrates a case where fluorescence discharge tubes 103 and 104 are employed as the illumination devices, and an self-excited inverter circuit is used as an ON/OFF control device therefor.

In the present example, the fluorescence discharge tubes 103 and 104 are longer than either longitudinal side of the LM information display section 101. The longitudinal sides of the light guide layer 102 are longer than either longitudinal side of the LM information display section 101, but shorter than the length of the fluorescence discharge tubes 103 and 104. For example, the fluorescence discharge tubes 103 and 104 may be about 400 mm, which is about 50 mm longer than the length of either longitudinal side of the light guide layer 102, which may be about 350 mm. In the present example, during the operation of the LM information display device 100, the fluorescence discharge tubes 103 and 104 are turned ON at least in a portion of a section A of each of the fluorescence discharge tubes 103 and 104 protruding from the light guide layer 102.

In FIG. 1A, the fluorescence discharge tube 103 represents a fluorescence discharge tube which is entirely-ON, whereas the fluorescence discharge tubes 104 represent fluorescence discharge tubes which are partially-ON. As used herein an "entirely-ON" state is defined as a state in which each entire fluorescence discharge tube is fluorescing. A "partially-ON" state is defined as a state in which at least a portion of a fluorescence discharge tube is fluorescing. A portion of each fluorescence discharge tube 104 which is shown in black represents a portion which is turned OFF. A portion of each fluorescence discharge tube 104 which is shown in white represents a portion which is turned ON (to be exact, "partially-ON"). The specific structure of fluorescence discharge tubes which can take a partially-ON state will be described later.

Figure 3:
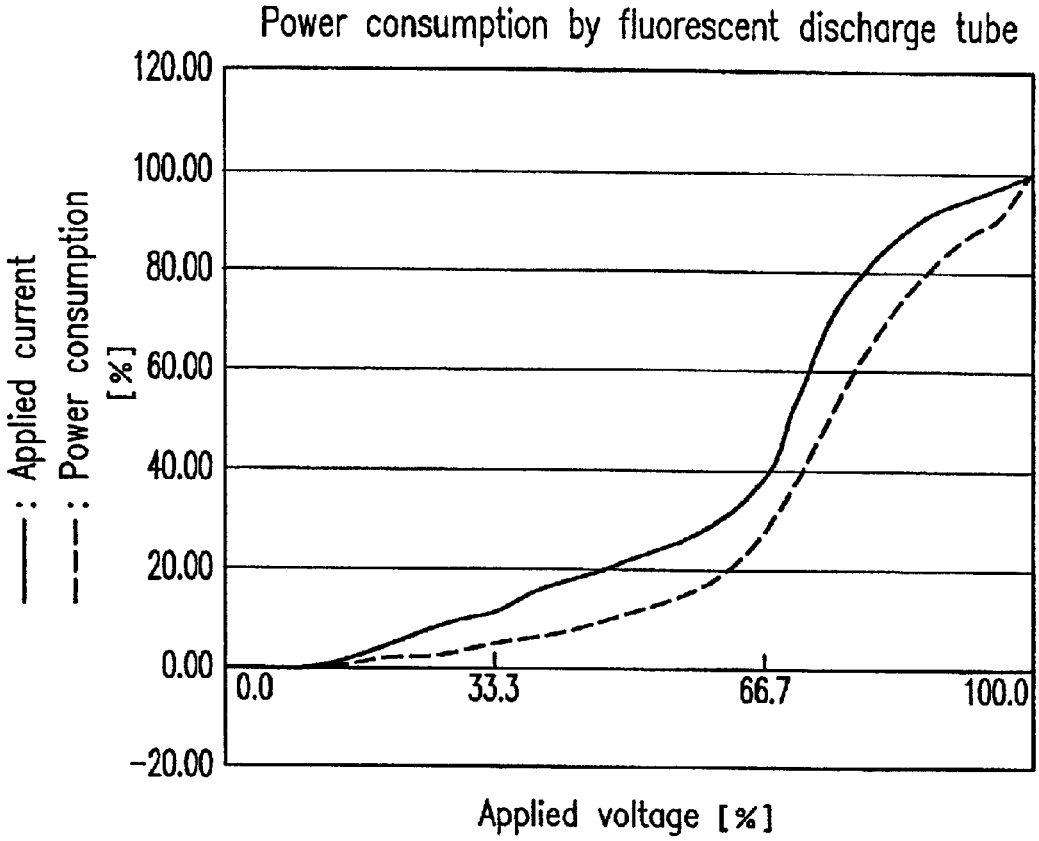
FIG. 3 is a graph showing actual measurement results representing a relationship between an input voltage/input current to an illumination device and the power consumption characteristics of the illumination device.

FIG. 3 shows actual measurement results representing a relationship between an input voltage/input current to an inverter and the emission of a fluorescence discharge tube. An inverter input voltage for turning the fluorescence discharge tubes 103 and 104 ON in a portion of the section A of each of the fluorescence discharge tubes 103 and 104 protruding from the light guide layer 102 can be determined from this relationship. The graph of FIG. 3 is obtained under the assumptions that the rated input voltage value Vcc [V] to the inverter circuit is 100% and the associated input current value Icc [mA] is 100%. In this case, assuming that an input voltage value for turning the fluorescence discharge tubes ON only in the section A of each of the fluorescence discharge tubes 103 and 104 protruding from the light guide layer 102 is $\alpha$[V], the signal which is to be input to the inverter according to the present example will be a rectangular wave having a predetermined frequency component whose voltage transitions between a and Vcc. Herein, Vcc, which may be set to be any arbitrary value, is a voltage which is required for causing each fluorescence discharge tube to be turned entirely-ON. The frequency of the rectangular wave is set based on switching intervals between the entirely-ON periods and any ON periods other than the entirely-ON periods, i.e., partially-ON periods, minimal discharging periods, or partial discharging periods (hereinafter, such periods will be referred to as "non-entirely-ON periods").

It should be noted that, the above-described partially-ON state can be obtained in the case where a fluorescent material is provided in the section A of each of the fluorescence discharge tubes 103 and 104. In the case where a fluorescent material is not provided in the section A of each of the fluorescence discharge tubes 103 and 104, a retention discharging (minimal discharging) or a partial discharge state results, instead of a partially-ON state.

Figure 1B:
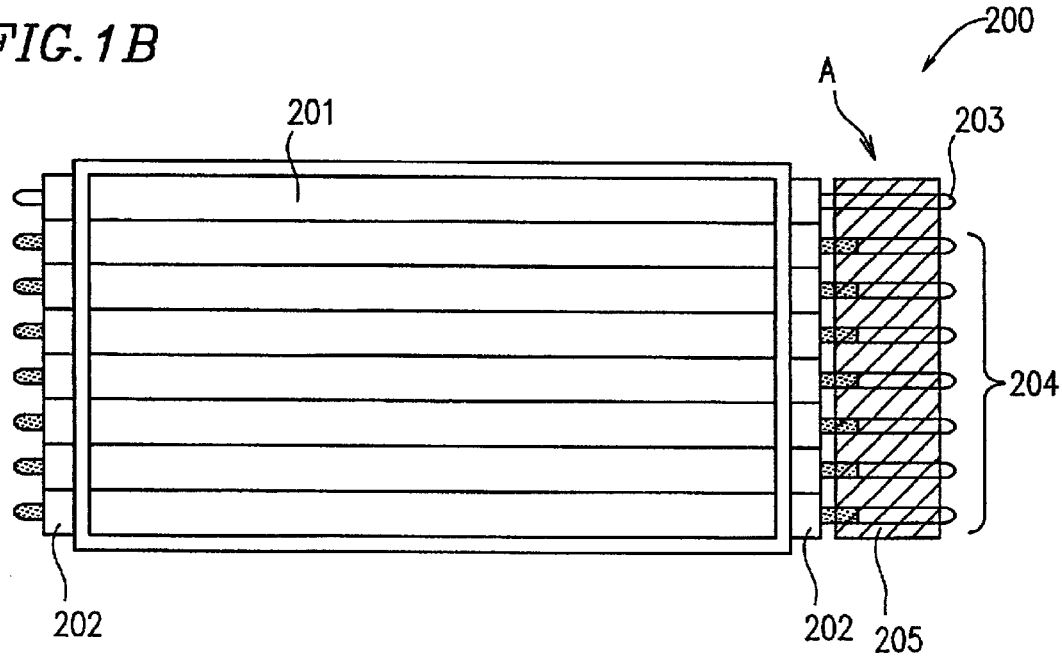
FIG. 1B is a plan view schematically illustrating a side-type backlight LM information display device according to Example 1 of the present invention.

In the case where an ON/OFF control device (inverter) 205 is provided on the back faces or the front faces of sections A of fluorescence discharge tubes 203 and 204 protruding from a light guide layer 202, as shown in FIG. 1B, it is possible to prevent the size of the entire LM information display device 200 from increasing despite the protruding configuration of the illumination devices 203 and 204 with respect to the light guide layer 202.

Figure 2:
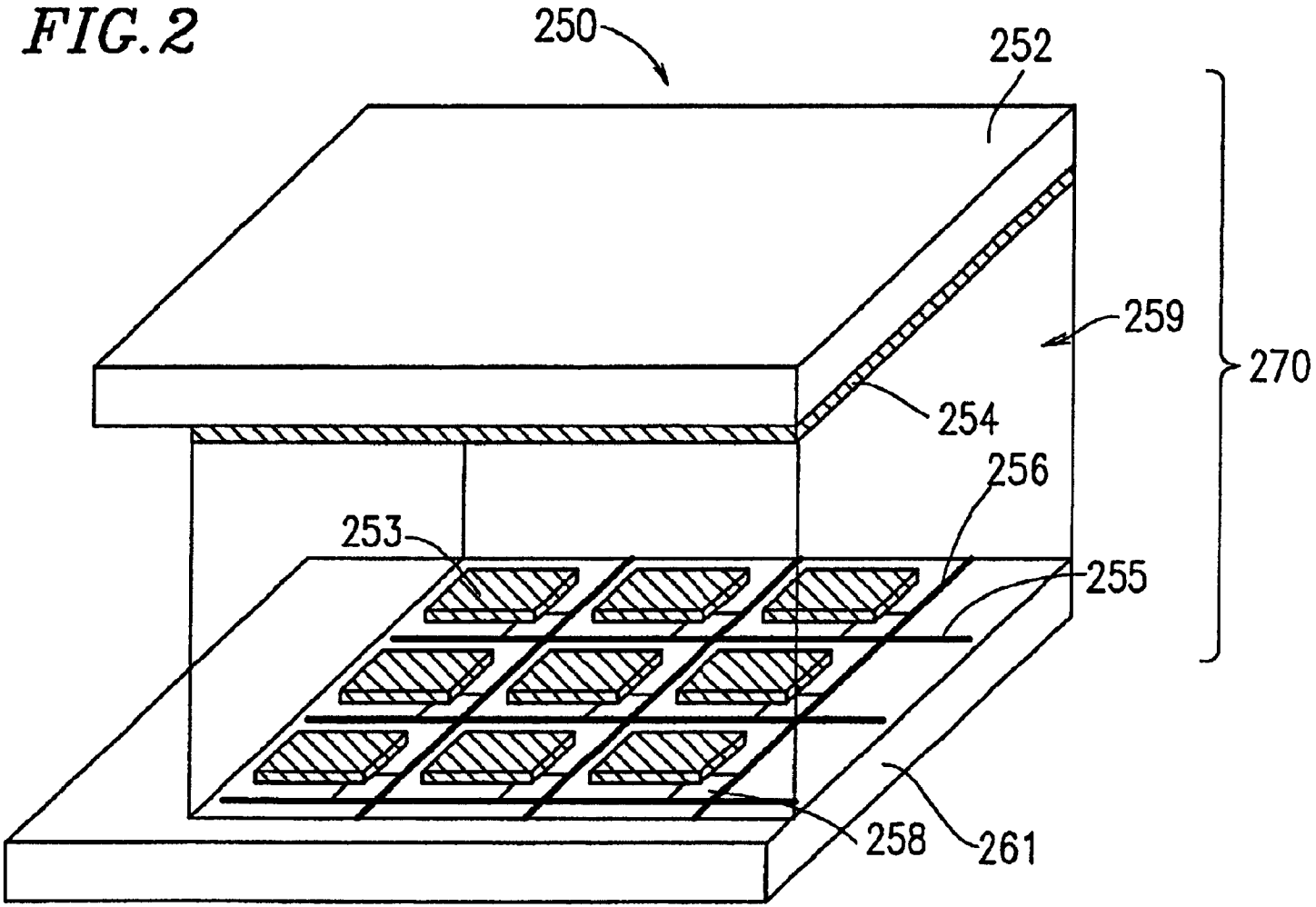
FIG. 2 is a schematic perspective view illustrating a liquid crystal display device, as an example of the LM information display device according to the present invention.

FIG. 2 is a schematic perspective view illustrating a liquid crystal display device 200, as an example of the LM information display device according to the present invention. The liquid crystal display device 200 is of an active-matrix TFT array type incorporating TFTs as light-switching elements 208, which can be advantageously employed for achieving a high display quality.

The liquid crystal display device 200 includes a liquid crystal layer 259 containing a liquid crystal material as a light modulation material interposed between a counter glass substrate 252 and a control glass substrate 261. The liquid crystal layer 259 is controlled by a common electrode 254 provided on the counter glass substrate 252 and a plurality of pixel electrodes 253 provided on the control glass substrate 261. On the control glass substrate 261, each of the plurality of pixel electrodes 253 is coupled to a corresponding source electrode 256 via a corresponding light-switching element (TFT) 258. A gate of each TFT 258 is coupled to a corresponding gate electrode 255. A liquid crystal panel 270 includes the counter glass substrate 252 and the control glass substrate 261. The LM information display section 101 shown in FIG. 1 corresponds to a region of the counter glass substrate 252 which contributes to displaying.

Figure 4:
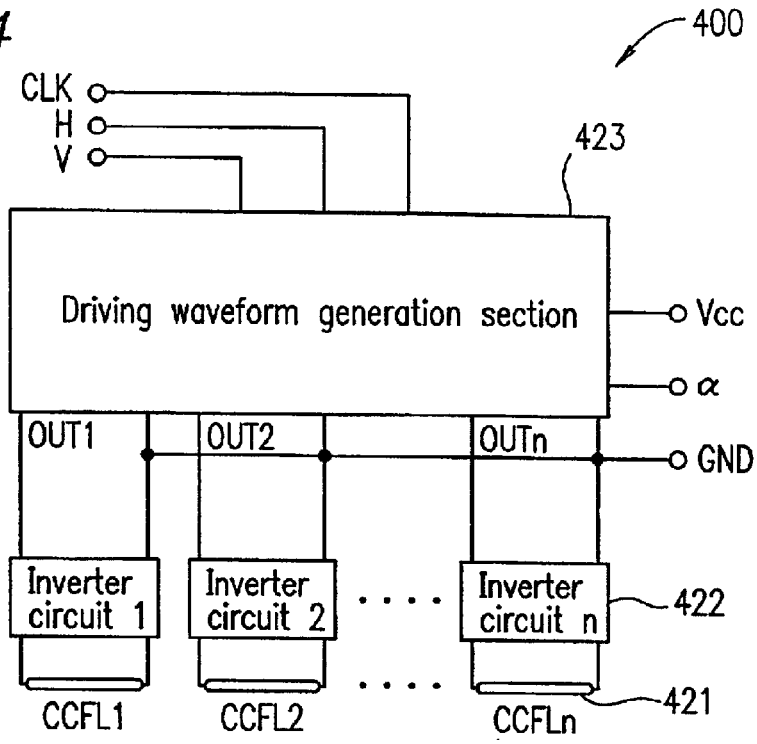
FIG. 4 is a block diagram illustrating the structure of an illumination control device for an LM information display device according to Example 1 of the invention.

FIG. 4 is a block diagram illustrating the structure of an illumination control device 400 according to the present example of the invention.

The illumination control device 400 includes an activation driving waveform generation section 423 and at least one fluorescence discharge tube 421. In the illumination control device 400 shown in FIG. 4, n fluorescence discharge tubes 421 are employed. An output signal from the activation driving waveform generation section 423 is input to the fluorescence discharge tubes 421 via respective inverter circuits 422.

The activation driving waveform generation section (activation state control section) 423 receives a clock signal (CLK), a horizontal synchronizing signal (H), and a vertical synchronizing signal (V), etc., (which are among information displaying signals which are input to the LM information display section 101 (FIG. 1A)). Furthermore, the activation driving waveform generation section 423 receives a rated input voltage (Vcc) and a partially-ON voltage ($\alpha$) for the ON/OFF control circuit (inverter circuit); these voltages will hereinafter be referred to as "illumination device driving voltages".

Based on the horizontal synchronizing signal (H) and the vertical synchronizing signal (V), the activation driving waveform generation section 423 determines which one of the output nodes (OUT1 to OUTn) illumination device driving voltages are to be output from, forms the output voltage pulses, and sets the output timing, by reference to the clock signal (CLK).

Assuming a count number Hc while the horizontal synchronizing signal (H) is driven and a total number Hline of horizontal scanning lines, and further assuming that the number of split display regions or split activatable regions, the number of illumination devices 421, and the number of inverter circuits 422 are all equal to n (where n is a natural number), the selection of the output nodes (OUT1 to OUTn) can be made in accordance with the following formula:

$$(p-1)/n \leqq Hc/H\text{line} \leqq p/n \quad (1)$$

(where p is a natural number: 1, 2, 3, . . . , n).

The output waveform (an "output voltage pulse") which is output at an output node(s) (OUT1 to OUTn) as derived from the above formula (1) is a rectangular wave having a predetermined frequency component whose voltage transitions from a ground potential (GND) to the rated input voltage (Vcc) for the inverter circuit 422. Since α[V] is supplied as an offset input to the activation driving waveform generation section 423 in the present example of the invention, the value of the rated voltage of the inverter circuit 422 takes Vcc−α[V] when α[V] is applied (that is, the rectangular wave transitions from α to Vcc).

In the present example, the pulse voltage(s) which is output through the selected output node(s) (OUT1 to OUTn) is input to the respective ON/OFF control circuit(s) (inverter circuit(s) 1 to n) 422, which control the turning ON/OFF of the respective fluorescence discharge tubes (CCFL1 to CCFLn) 421. Thus, the respective fluorescence discharge tubes are controlled so as to be turned ON or OFF as selected.

Figure 5:
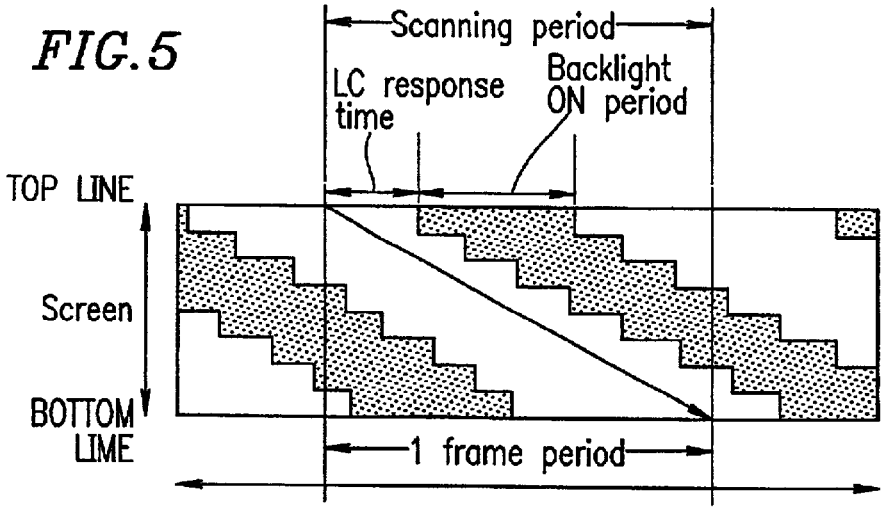
FIG. 5 is a timing diagram illustrating the fundamental operation principles of a region scanning-type activation scheme in the LM information display device according to Example 1 of the present invention.

FIG. 5 is a timing diagram illustrating scanning periods of the LM information display section 101 and entirely-ON periods of the illumination devices (backlights) 103 and 104 according to the present example.

During 1 frame period, which defines a period in which signal scan across a display screen of the LM information display section 101, a screen scanning period is set from the horizontal synchronizing signal (H) and the vertical synchronizing signal (V). In the exemplary case illustrated in FIG. 5, the horizontal scanning line is sequentially moved from the top line to the bottom line of the screen with the lapse of time.

The LM information display section 101 shown in FIG. 1A is split into a plurality of split display regions (101*a*, 101*b*, 101*c*, 101*d*, . . . , etc.). Split activatable regions (103*a*, 103*b*, 103*c*, 103*d*, . . . , etc.) of the illumination devices 103 and 104 are provided so as to correspond to the respective split display regions of the LM information display section 101. At least one fluorescence discharge tube is provided for each split activatable region. In the illumination control device 100 illustrated in FIG. 1A, one fluorescence discharge tube is provide for each split activatable region.

A delay time which corresponds to the response time of the light modulation material (i.e., a liquid crystal material in the present example) is generated by means of a delay circuit or the like in the activation driving waveform generation section 423. When a scanning signal is applied to a split display region in the LM information display section 101, after the lapse of the delay time, a pulse voltage for driving the inverter circuit 422 associated with the split activatable region corresponding to that split display region is output. For example, as shown in FIG. 5, once the scanning of a given number of horizontal lines (within a given split display region) is completed, the fluorescence discharge tube (in a corresponding split activatable region) is turned ON, with a delay time which is equivalent to the delayed response of the liquid crystal material. It is preferable to take into account not only the delayed response of the liquid crystal material, but also the response time of the light-switching elements. The above operation is repeated for each ensuing region.

Thus, split the fluorescence discharge tube(s) corresponding to the split activatable region(s) which are selected to be turned ON in accordance with the above formula (1) can be driven so as to enter a backlight ON period. As used herein, a "backlight ON period" is defined as a period during which a given fluorescence discharge tube is turned entirely-ON. In the exemplary case illustrated in FIG. 5, the step-like hatched regions are the backlight ON periods. Similarly to the scanning sites, the backlight ON periods are sequentially moved from the top line to the bottom line of the screen with the lapse of time on a split activatable region-by-split activatable region basis.

It is preferable to take into account not only the delayed response of the liquid crystal material but also the response time of the light-switching elements.

During any periods ("partially-ON split periods") other than the backlight ON periods, the portions of the fluorescence discharge tubes 104 which are indicated in white in FIG. 1A, i.e., the portions (denoted as A in FIG. 1A) lying outside an effective display area of the LM information display section 101, are turned ON, whereas the portions within the effective display area are maintained at a luminance value equivalent to that during OFF periods. Thus, the fluorescence discharge tubes 104 are turned "partially-ON".

In the present example, at least one illumination device needs to be provided for each split activatable region (103*a*, 103*b*, 103*c*, 103*d*, . . . , etc.). Two or three or more fluorescence discharge tubes may be provided for each split activatable region. It is also possible to provide two or more split activatable regions corresponding to each split display region (101*a*, 101*b*, 101*c*, 101*d*, . . . , etc.).

EXAMPLE 2

Figure 6:
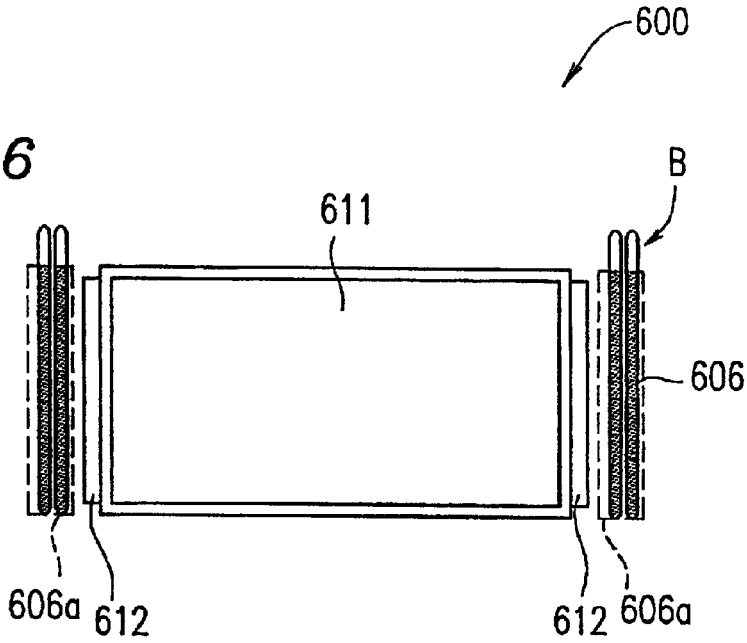
FIG. 6 is a plan view schematically illustrating a side-type backlight LM information display device according to Example 2 of the present invention.

FIG. 6 is a plan view schematically illustrating a side-type backlight LM information display device 600 according to Example 2 of the present invention.

The side-type backlight LM information display device 600 includes an LM information display section 611, a light guide layer 612 for guiding light into the LM information display section 611, a lamp reflector 606*a* for deflecting light toward the light guide layer 612, and at least one fluorescence discharge tube 606 which is partially surrounded by the lamp reflector 606*a*. Although the illumination devices (the fluorescence discharge tubes 606) in the LM information display device 600 of FIG. 6 are disposed perpendicularly to the horizontal scanning lines of the LM information display section 611, illumination devices may alternatively be provided in parallel to the horizontal scanning lines. The fluorescence discharge tube(s) 606 and the lamp reflector(s) 606*a* do not need to be provided on both sides of the light guide layer 612, but may only be provided on at least one side of the light guide layer 612.

In the present example, each fluorescence discharge tube 606 is longer than the shorter dimension of the effective display area of the LM information display section 611 and either of the shorter sides of the light guide layer 612. Each fluorescence discharge tube 606 is capable of being turned ON only in a section B protruding from the effective display area of the LM information display section 611 and the light guide layer 612. The portions of the fluorescence discharge tubes 606 shown in black in FIG. 6 represent portions which can be turned ON or controlled so as to be in an OFF, whereas the portions shown in white represent portions which are controlled so as to be always ON. In other words, when the portions of the fluorescence discharge tubes 606 which are shown in black in FIG. 6 are turned ON, the fluorescence discharge tubes 606 are turned entirely-ON. When the portions of the fluorescence discharge tubes 606 which are shown in black in FIG. 6 are controlled so as to enter an OFF state, the fluorescence discharge tubes 606 are turned partially-ON. Note that the present example assumes that a fluorescent material is provided in the sections B.

Also in the present example, the ON/OFF control of the fluorescence discharge tube 606 can be realized with the illumination control device 400 having the circuit configuration shown in FIG. 4. However, the activation timing of the fluorescence discharge tubes 606 differs from that employed in Example 1 in that the completion of scanning over the entire screen is detected based on the CLK, H, or V signal or the frame frequency, and that an ON waveform for a plurality of inverter circuits is simultaneously output after the generation of a driving waveform (with a delay corresponding to the delayed response of the liquid crystal material used). It is preferable to take into account not only the delayed response of the liquid crystal material but also the response time of the light-switching elements.

Figure 7:
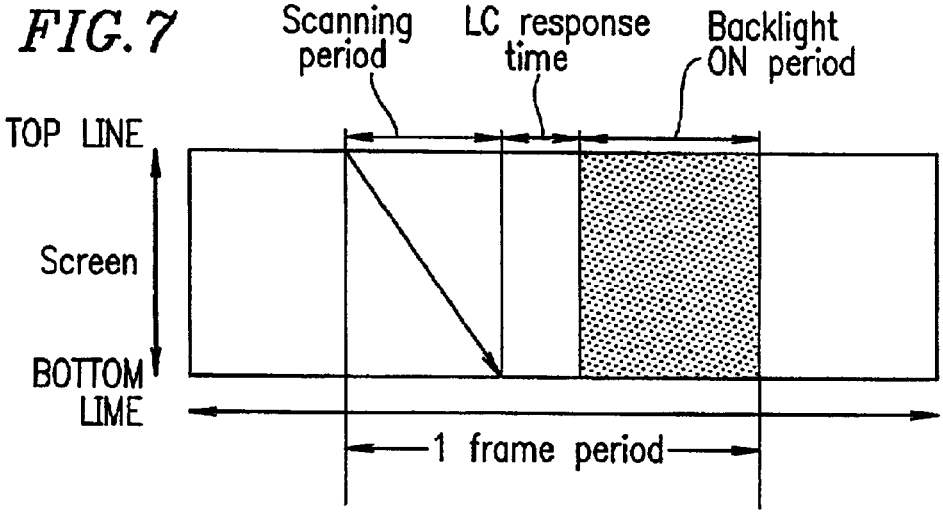
FIG. 7 is a timing diagram illustrating the fundamental operation principles of a display screen all-flash type activation scheme in the LM information display device according to Example 2 of the present invention.

FIG. 7 is a timing diagram illustrating scanning periods of the LM information display section 611 and entirely-ON periods of the illumination devices (side-type backlights) 606 according to the present example.

In the present example, unlike in Example 1 (where split activatable regions were employed), the completion of scanning over the entire screen is detected, and thereafter a driving waveform is applied to the fluorescence discharge tubes 606 with a delay corresponding to the delayed response of the liquid crystal material used. As a result, during the backlight ON periods shown as hatched portions in FIG. 7, all of the fluorescence discharge tubes 606 serving as illumination devices are simultaneously turned entirely-ON.

During any periods ("partially-ON periods") other than the backlight ON periods, the portions of the fluorescence discharge tubes 606 which are indicated in white in FIG. 6, i.e., the portions (denoted as B in FIG. 6) lying outside the effective display area of the LM information display section 611, are turned ON, whereas the portions of the fluorescence discharge tubes 606 (shown in black) which face the light guide layer 612, which serves to guide light into the effective display area of the LM information display section 611, are maintained at a luminance value equivalent to that during OFF periods. Thus, the fluorescence discharge tubes 606 are turned "partially-ON".

As described above in Example 1, in accordance with a formula which is based on the count number (Hc) of the horizontal synchronizing signal(H) and the number (n) of split activatable regions, a plurality of illumination devices in the split activatable regions corresponding to the split display regions can be sequentially turned entirely-ON while taking into account the delayed response of the light-switching elements and/or the light modulation material (e.g., liquid crystal material).

In the alternative, as described in Example 2, the completion of a scanning period may be detected, and thereafter a plurality of illumination devices can be simultaneously turned entirely-ON while taking into account the delayed response of the light-switching elements and/or the light modulation material.

The illumination devices in the illumination control devices can be controlled so as be partially-ON or entirely-ON in such a manner that a portion of each illumination device which is protruding outside the effective display area of the LM information display section is turned ON during periods other than the entirely-ON periods (i.e., partially-ON periods), in non-entirely-ON (e.g., partially-ON) split activatable regions. As a result, in both Example 1 and Example 2, redundant power consumption is minimized, and an illumination device having an excellent device life and high reliability can be obtained.

The improvement in the device lives of the fluorescence discharge tubes and the inverter circuits, which is realized by the use of the aforementioned control methods which cause illumination devices to be partially-ON or entirely-ON, accrues through the following mechanism.

Figure 8:
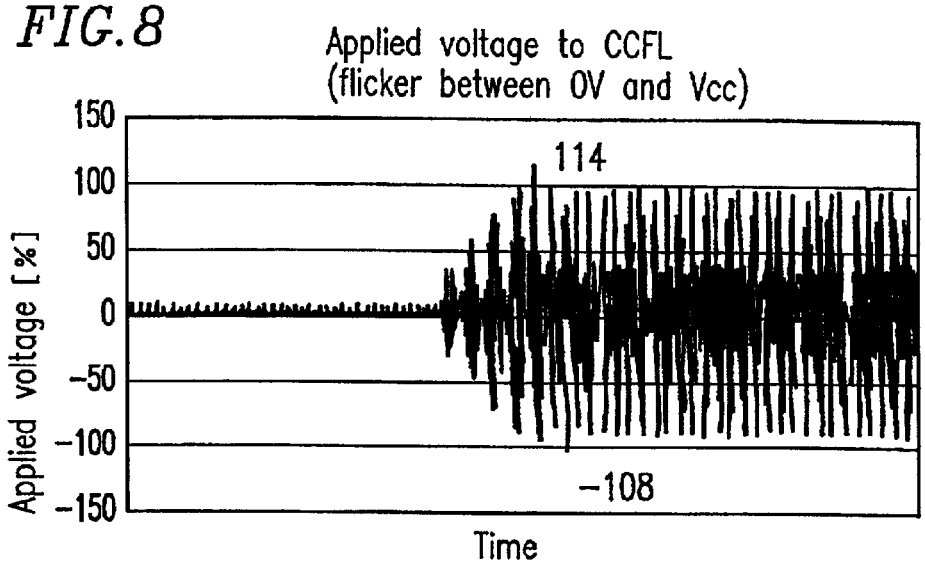
FIG. 8 is a graph illustrating a waveform which is applied to a fluorescence discharge tube in a conventional control method which repeats turning ON and OFF.
Figure 9:
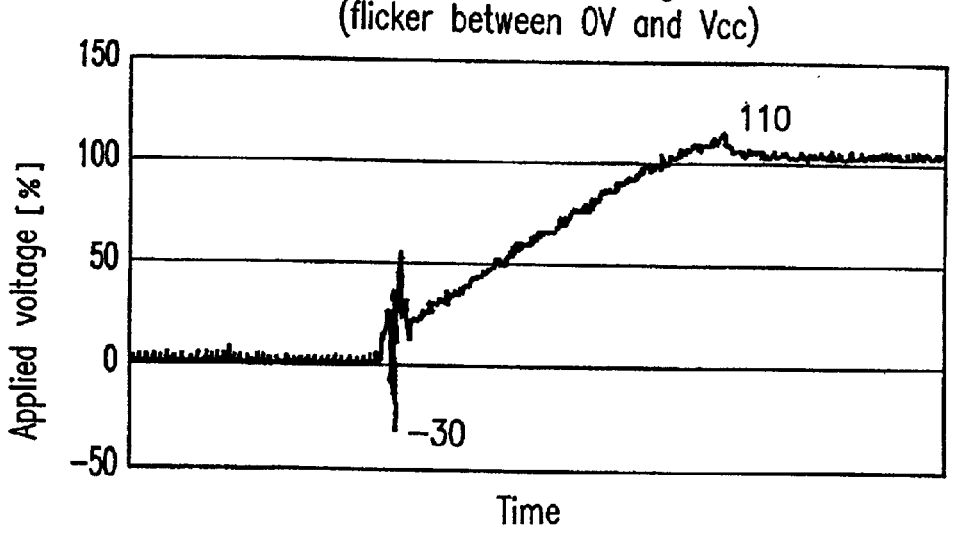
FIG. 9 is a graph illustrating a waveform which is applied to an inverter in a conventional control method which repeats turning ON and OFF.

For comparison, a waveform which is applied to the fluorescence discharge tubes in a conventional control method which repeats turning ON and OFF is shown in FIG. 8, and a corresponding waveform which is input to an inverter is shown in FIG. 9.

In a conventional control method which repeats turning ON and OFF, a step-up operation is performed in a piezoelectric transformer section in the inverter circuit when a fluorescence discharge tube transitions from an OFF state to an ON state, in order to deal with a high impedance within the fluorescence discharge tube. As a result, at the beginning of the discharging, an excessive voltage and an excessive current may be applied to the fluorescence discharge tube. In addition, due to causes associated with the performance of the power source, impulse noises such as an undershoot may be added to the inverter input voltage at the beginning of the discharging, so that a potential difference exceeding the rated input voltage value for the inverter circuit may be temporarily applied. These factors shorten the device life of the illumination device. Such an excessive voltage and excessive current becomes especially outstanding in the case where the turning ON and OFF of a fluorescence discharge tube is controlled by means of an open-close type switch. The excessive voltage at the beginning of the discharging causes deterioration of the electrodes of the fluorescence discharge tube, as well as blackening of the fluorescent material in the vicinity of the electrodes due to electron sputtering.

Figure 10:
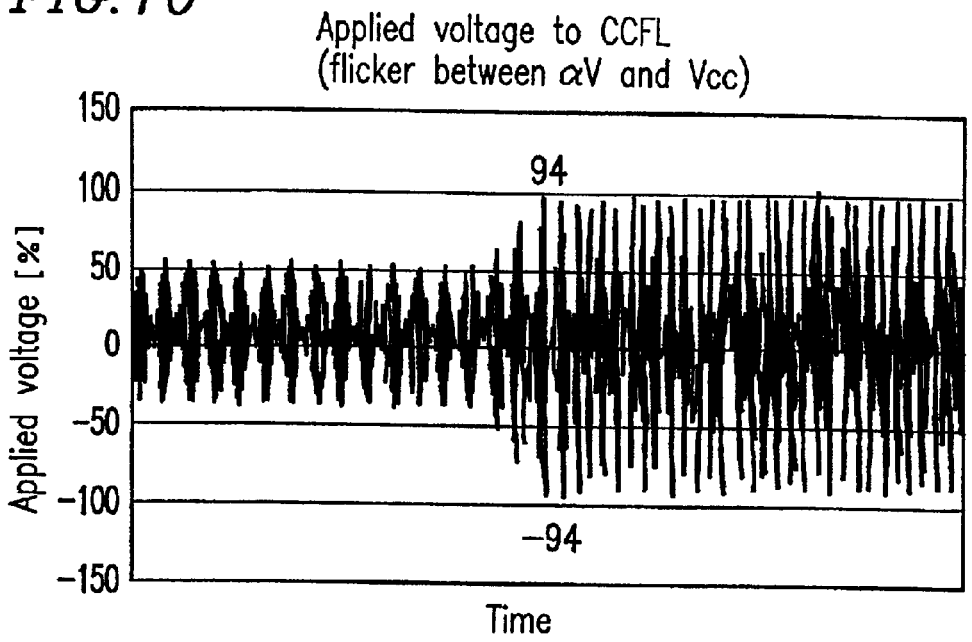
FIG. 10 is a graph illustrating a waveform which is applied to a fluorescence discharge tube according to an example of the present invention.

In contrast thereto, FIG. 10 shows a waveform which is applied to the fluorescence discharge tubes in the control method according to Example 1 or 2 of the present invention, which involves repetitively turning the illumination device partially-ON or entirely-ON. A corresponding waveform which is input to the inverter is shown in FIG. 11.

Figure 11:
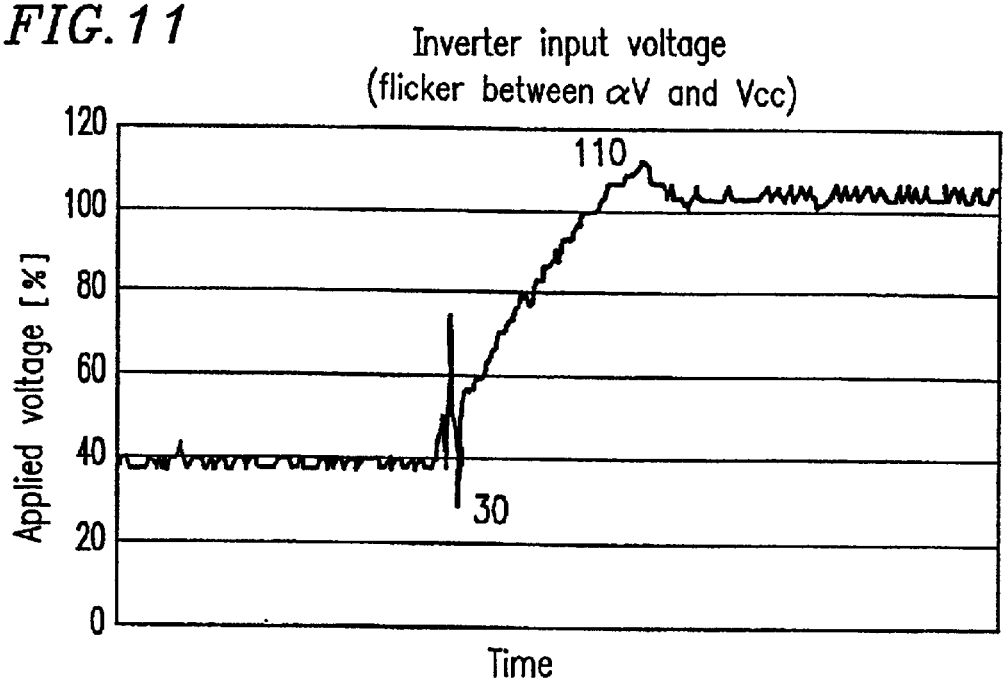
FIG. 11 is a graph illustrating a waveform which is applied to an inverter according to an example of the p resent invention.

As seen from FIGS. 10 and 11, the potential which is applied to the fluorescence discharge tube when turning entirely-ON the fluorescence discharge tube is flattened, with no instantaneous excessive voltage being generated. It is also clearly seen from FIGS. 10 and 11 that the inverter input waveform indicates a much reduced undershoot noise, with an applied potential which is equal to or below the rated voltage value. Thus, the excessive voltage component received by the fluorescence discharge tube and the inverter circuit can be alleviated.

In order to confirm the improvement in the luminance and power consumption, the inventors conducted an experiment as follows: (1) the aforementioned control method which causes the illumination devices to be turned partially-ON or entirely-ON was used; (2) the fluorescence discharge tube length was designed so as to be longer than the corresponding dimension of the light guide layer and the corresponding dimension of the effective display area of the LM information display section, and sections (denoted as B in FIG. 6) protruding outside the light guide layer and the effective area of the LM information display section were subjected to a partially-ON state, a retention discharging (minimal discharging), or a partial discharging, with respect to each split activatable region, during any periods other than the entirely-ON periods; and (3) the activation states of the respective split activatable regions were individually controlled based on information displaying signals such as the horizontal synchronizing signal, the vertical synchronizing signal, the clock signal, or the like. As a result, an improvement in the luminance and power consumption was obtained as follows.

Table 1 shows the optical characteristics obtained by the illumination control device according to the present invention (with flickering between α[V]–Vcc) in comparison with the optical characteristics (with flickering between 0[V]–Vcc) obtained by a conventional control method which repeats turning ON and OFF.

TABLE 1

| Measurement # | (flicker between OV and Vcc) Luminance [%] | (flicker between αV and Vcc) Luminance [%] |
|---|---|---|
| 1 | 100.0 | 103.4 |
| 2 | 99.9 | 103.4 |
| 3 | 100.2 | 103.3 |
| 4 | 99.9 | 103.6 |
| 5 | 100.0 | 103.5 |
| Ave. | 100.0 | 103.4 |

As seen from Table 1, the present invention provides an about 3% improvement relative to the luminance level obtained with the conventional control method. The inventors have also confirmed that the luminance for the non-entirely-ON (i.e., partially-ON, retention discharging, or partial discharging) split display regions during the non-displaying periods (the partially-ON period, retention discharging period, or the partial discharging period) was 0.01% or less, which implies no contribution to the improvement in the luminance during a partially-ON period. This improvement in luminance can be, as seen from the comparison between FIG. 9 and 11, explained by the fact that the voltage rising characteristics (from 0% to 90%) obtained by the conventional control method which repeats turning ON and OFF indicate a rise time of about 700 μsec, as opposed to 400 μsec according to the examples of the present invention, which involve repetition of partially-ON states and entirely-ON states. In other words, the rise time is being reduced owing to an offset-like component which is applied during a partially-ON state, so that an illumination integral corresponding to this portion appears as the improvement In luminance. Note that the "reduction" of the rise time as used herein does not mean any steeper rising slope, but simply means that a period corresponding to a transition from 0[V] to α[V] is eliminated.

Again, FIG. 3 shows a relationship between a voltage, a current applied to a fluorescence discharge tube, and the power consumption characteristics, in the case where a 60 Hz rectangular wave is applied to the fluorescence discharge tube.

Referring to FIG. 3, the activation state of the fluorescence discharge tube as read based on the voltage value will be discussed. The fluorescence discharge tube is OFF, i.e., not turned ON, in a voltage region between 0% and 15%. Above 15%, a partially-ON state begins from the electrode to which a higher voltage is applied; it can be seen that the increase in power consumption in this voltage region is relatively gentle. As the voltage value reaches 60%, the fluorescence discharge tube emits light in its entire region. Thereafter, the tube surface attains a higher luminance as the voltage value is increased; it can be seen that the increase in power consumption in this voltage region (entirely-ON region) is steep.

Based on these results, the power consumption per fluorescence discharge tube is calculated to be 50.9% according to the examples of the present invention, which involve repetition of partially-ON states and entirely-ON states, where the power consumption in the case where the fluorescence discharge tube is always ON is defined as 100%. On the other hand, the power consumption per fluorescence discharge tube is 50.0% according to the conventional control method which repeats turning ON and OFF, which is substantially the same as that power consumption according to the present invention. In contrast, the power consumption per fluorescence discharge tube according to the conventional light regulation (bright/dark) method is 62.9%, over which the present invention has relative excellency. The power consumption calculation is based on the assumptions that, in the case where the fluorescence discharge tube is caused to be turned either partially-ON or entirely-ON, the voltage value required for a partially-ON state is 25% of the minimum voltage value which enables an entirely-ON state; and that, when the fluorescence discharge tube receives light regulation (bright/dark), the voltage value required for the dark state is 60% of the minimum voltage value which enables an entirely-ON state.

The above results are summarized in Table 2 below. Table 2 comparatively illustrates the respective power consumption, device life, display characteristics, etc., that are obtained according to the conventional control method which repeats turning ON and OFF, the conventional light regulation (bright/dark) method, or the examples of the present invention which involve repetition of partially-ON states and entirely-ON states, with respect to a case where a 60 Hz rectangular wave is applied to the illumination device.

TABLE 2

| Activation method | consumption | Power Luminance | Device life | moving picture | Display quality of |
|---|---|---|---|---|---|
| Conventional | ON/OFF | ○ | Δ | X | ○ |
| | Light regulation (bright/dark) | X | ○ | ○ | X |
| Invention | Partially-ON/ entirely-ON | ○ | Δ | ○ | ○ |

As seen from Table 2, the illumination control device according to the present invention, which repeats partially-ON states and entirely-ON states, is effective in terms of device life, power consumption, and display characteristics.

Figure 12A:
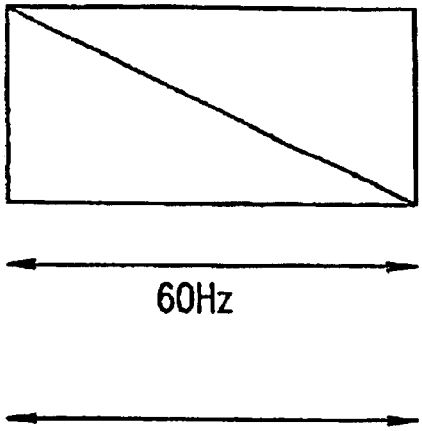
FIG. 12A is a schematic diagram illustrating an activation state of a fluorescence discharge tube in a conventional LM information display device.
Figure 12B:
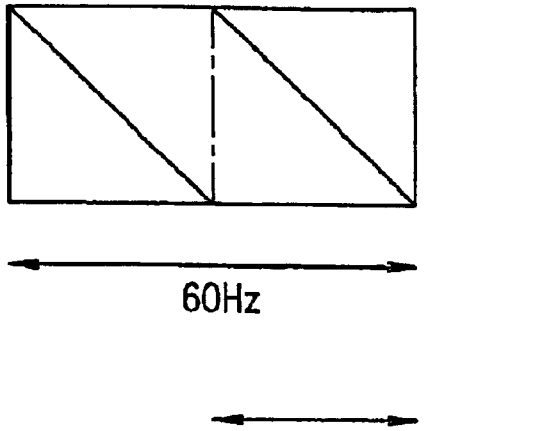
Prior Art FIG. 12B
FIG. 12B is a schematic diagram illustrating an activation state of a fluorescence discharge tube in the LM information display device according to Example 2 of the present invention.

Thus, the illumination control device according to the present invention, which repeats partially-ON states and entirely-ON states, clearly provides a greater improvement in luminance than a complete OFF-ON (conventional ON/OFF) scheme. Now, the mechanism of power consumption reduction will be discussed. As shown in FIG. 12A, with a state-of-the-art scanning rate of 60 Hz, the fluorescence discharge tube is maintained always ON. According to the present example, as shown in FIG. 12B, a scanning may be performed at, e.g., a double rate (scanning rate: 120 Hz) in such a manner that the fluorescence discharge tube is not turned ON during the first 120 Hz period, but turned ON during the next 120 Hz period. As a result, the fluorescence discharge tube is turned ON for a duration which is only half of 1 frame (60 Hz), thereby resulting in half the conventional power consumption level. Thus, the power consumption reduction according to the present invention has been explained.

Although the description of the above example is chiefly directed to a control method for selectively causing a partially-ON or an entirely-ON state, similar characteristics according to the present invention can also be obtained with a control method for selectively causing a minimal discharging or an entirely-ON state, or with a control method f or selectively causing a partial discharging or an entirely-ON state.

Although the above description is directed to a transmission LM information display device which displays information by variably controlling a light transmission state, the present invention is not limited thereto. For example, the present invention is also applicable to an LM information display device in which an LM information display section variably controls the absorption, interception, reflection state, or reflection direction of light from an illumination control device. The light modulation material is not limited to liquid crystal. Furthermore, although a backlight control device in which a light guide layer is provided on a back face of an LM information display section has been described, the present invention is also applicable to a frontlight control device in which a light guide layer is provided on a front face of an LM information display section. In this case, an activation timing scheme such as that illustrated in Example 2 can be preferably used. However, in the case where a light valve composed of a reflection liquid crystal device is employed in a projection system, an illumination control device which realizes a scanning-based activation function as described in Example 1 can also be employed. Specific examples of the LM information display device according to the present invention include, for example, a transmission liquid crystal display device, a reflection liquid crystal display device, a DMD, a mechanical shutter element, and the like.

EXAMPLE 3

Figure 13:
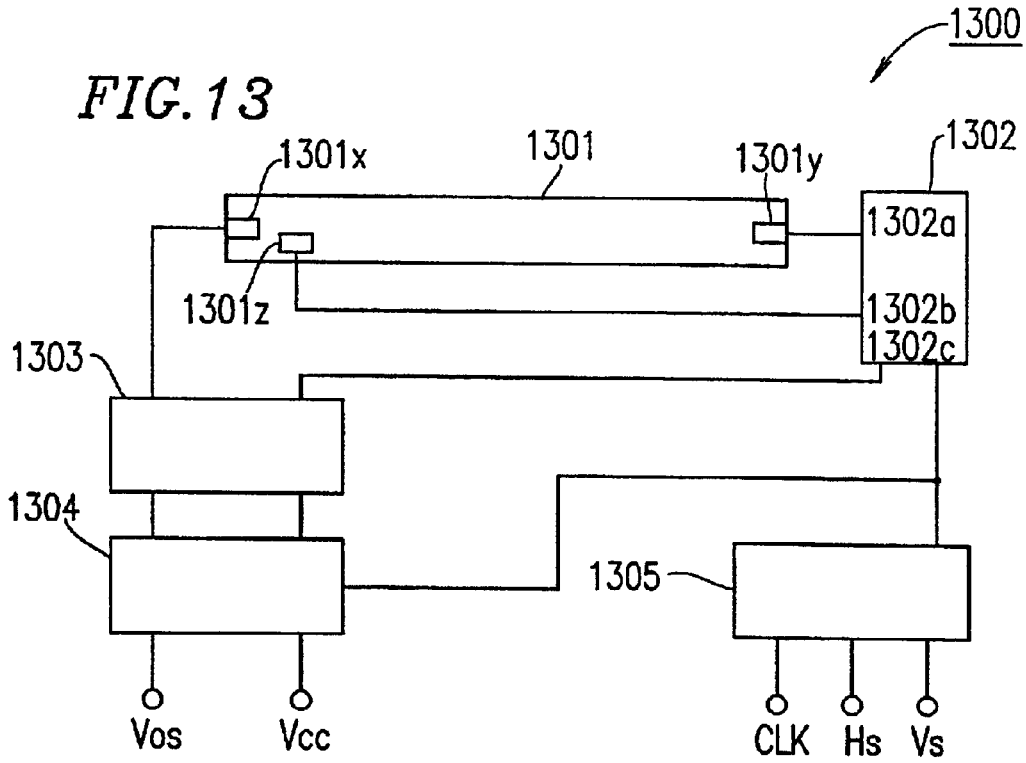
FIG. 13 is a block diagram schematically illustrating an illumination control device according to Example 3 of the present invention.

FIG. 13 is a block diagram schematically illustrating an illumination control device 1300 according to Example 3 of the present invention.

The illumination control device 1300 includes a cold-cathode fluorescence discharge tube 1301, an electrode selection circuit 1302, an inverter circuit 1303, a driving waveform generation section 1304, and an activation synchronization signal generation circuit 1305.

The diameter and tube length of the cold-cathode fluorescence discharge tube 1301 are diameter $\phi$=2.6 and 400 mm, respectively. A fluorescent material is applied to the inner surface of the cold-cathode fluorescence discharge tube 1301. The total gas pressure within the cold-cathode fluorescence discharge tube 1301 is 60 Torr. Ag and Hg are contained within the fluorescence discharge tube 1301 as main gas components. The cold-cathode fluorescence discharge tube 1301 includes main discharging electrodes 1301*x* and 1301*y* provided on both ends thereof for turning the fluorescence discharge tube 1301 entirely-ON. A partial discharging electrode 1301*z* is provided in the vicinity of the main discharging electrode 1301*x*.

Hereinafter, the operation of the illumination control device 1300 according to the present example will be described.

Among the information displaying signals which are input to the LM information display section, the clock signal (CLK), the horizontal synchronizing signal (Hs), and the vertical synchronizing signal (Vs) are input to the activation synchronization signal generation circuit 1305. In the present example, in order to confirm the operation of the illumination control device alone, away from any influences of the LM information display section, a 60 Hz rectangular wave which transitions between an entirely-ON period setting voltage (5V) and a non-entirely-ON period setting voltage (partially-ON period setting voltage or partial discharging period setting voltage) (0V) was employed as an input signal to the activation synchronization signal generation circuit 1305. The entirely-ON period setting voltage which is output from the activation synchronization signal generation circuit 1305 is input to the driving waveform generation section 1304, thereby switching the operation of the driving waveform generation section 1304.

Figure 15:
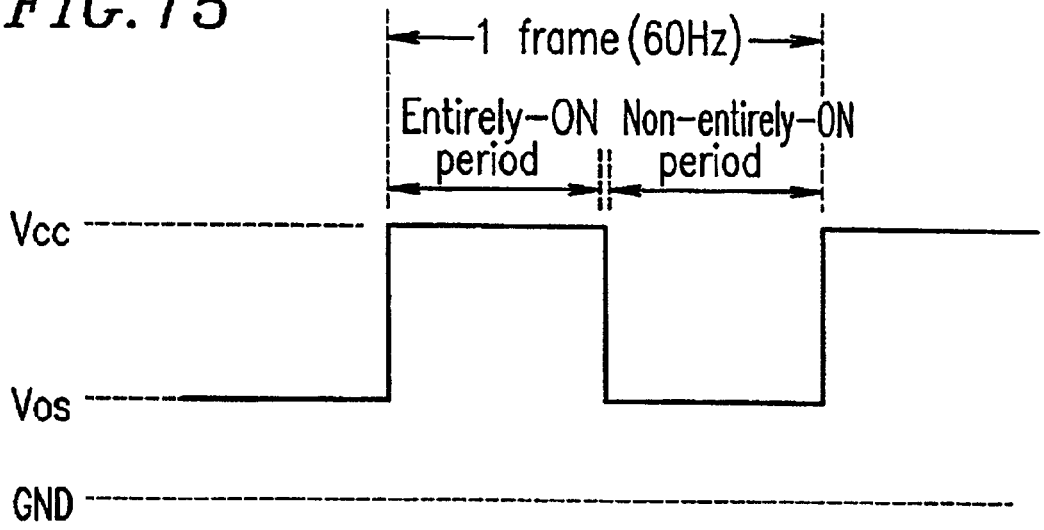
FIG. 15 is a timing diagram illustrating an inverter driving signal which is output from an inverter driving waveform generation section according to the present invention.

In the present example, the driving waveform generation section 1304 outputs an activating rated voltage Vcc during a period in which the signal voltage which is input from the activation synchronization signal generation circuit 1305 is 5V, i.e., the entirely-ON period of the cathode fluorescence discharge tube 1301. During a period in which the signal voltage which is input from the activation synchronization signal generation circuit 1305 is 0V, i.e., the non-entirely-ON period (a partially-ON period or a partial discharging period) of the cathode fluorescence discharge tube 1301, the driving waveform generation section 1304 outputs Vos. Accordingly, the output signal from the driving waveform generation section 1304 is a rectangular wave having the two voltage values Vcc and Vos as shown in FIG. 15. The frequency of this rectangular wave is set based on switching intervals between the entirely-ON periods and the non-entirely-ON periods.

The output signal from the driving waveform generation section 1304 (the 60 Hz rectangular wave shown in FIG. 15) is input to the inverter circuit 1303, whereby a fluorescence discharge tube driving signal is generated. The fluorescence discharge tube driving signal has a profile such that a fluorescence discharge tube activating rated voltage pulse Vpcc (which is at a level on the order of tens to thousands of times Vcc) is output during an entirely-ON period, whereas a fluorescence discharge tube partially-ON or partially discharging voltage pulse Vos (which is the order of tens to thousands of times Vos) is output during a non-entirely-ON period (a partially-ON period or a partial discharging period). The entirely-ON voltage Vpcc is a voltage which is required to cause the fluorescence discharge tube 1301 to be turned entirely-ON. The entirely-ON voltage Vpcc is prescribed based on factors such as the length of the fluorescence discharge tube 1301, gas pressure, and the like. As the fluorescence discharge tube 1301 becomes longer, the resistance between the two electrodes of the fluorescence discharge tube 1301 becomes higher, hence requiring a higher discharge starting voltage for causing a discharging current to flow.

With respect to one fluorescence discharge tube 1301, the resistance value between the first electrode 1301*x* and the second electrode 1301*y* (i.e., the entirely-ON electrodes), and the resistance value between the first electrode 1301*x* and the third electrode 1301*z* (i.e., the partial discharging electrode) vary depending on the distances between the respective electrodes. Therefore, the partially-ON voltage or partially discharging voltage may be set depending on these distances.

The electrode selection circuit 1302 includes an output terminal 1302*a* and an output terminal 1302*b*, and a connection terminal 1302*c*. During a period in which the signal voltage which is input from the activation synchronization signal generation circuit 1305 is 5V, i.e., an entirely-ON period of the fluorescence discharge tube 1301, the output terminal 1302*a* of the electrode selection circuit 1302 is coupled to the connection terminal 1302*c* between the electrode selection circuit 1302 and the inverter circuit 1303, and the output terminal 1302*b* of the electrode selection circuit 1302 is in an open state. At this time, since the output from the inverter circuit 1303 is in an entirely-ON period, the fluorescence discharge tube activating rated voltage pulse (Vpcc) is applied between the main discharging electrodes 1301*x* and 1301*y* of the cold-cathode fluorescence discharge tube 1301, so that the cold-cathode fluorescence discharge tube 1301 is turned entirely-ON.

During a non-entirely-ON period (a partially-ON period or a partial discharging period) of the fluorescence discharge tube 1301, i.e., a period during which the signal voltage value which is input from the activation synchronization signal generation circuit 1305 is 0V, the output terminal 1302*b* of the electrode selection circuit 1302 is coupled to the connection terminal 1302*c* between the electrode selection circuit 1302 and the inverter circuit 1303, and the output terminal 1302*a* of the electrode selection circuit 1302 is in an open state. At this time, since the output from the inverter circuit 1303 is in a non-entirely-ON period (a partially-ON period or a partial discharging period), a fluorescence discharge tube partially-ON or partially discharging voltage pulse (Vpos) is applied between the main discharging electrode 1301*x* and the partial discharging electrode 1301*z* of the cold-cathode fluorescence discharge tube 1301, so that the fluorescence discharge tube 1301 is turned partially-ON or caused to partially discharge. The main discharging electrode 1301*y* of the fluorescence discharge tube 1301 is provided in a region corresponding to the effective display area of the LM information display section. The main discharging electrode 1301*x* and the partial discharging electrode 1301*z* of the fluorescence discharge tube 1301 are provided in regions not corresponding to the effective display area of the LM information display section.

Figure 16:
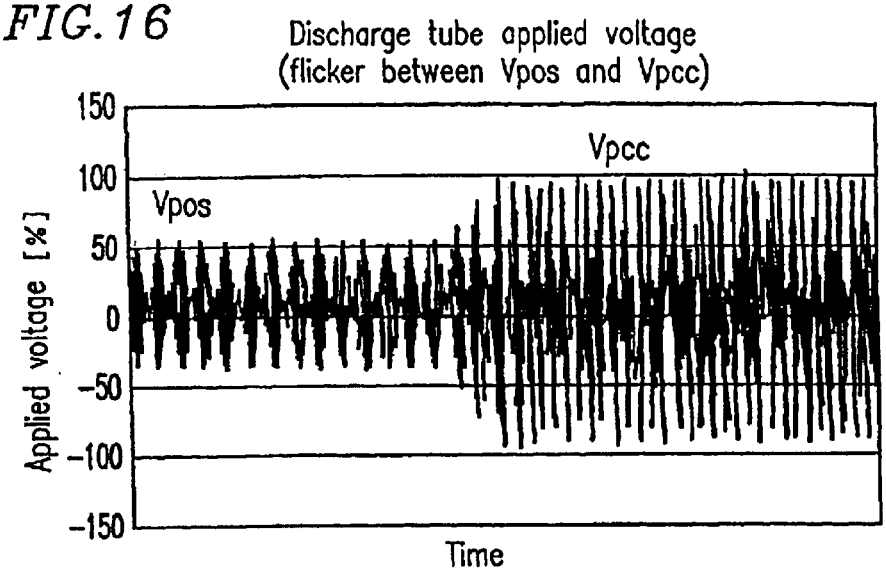
FIG. 16 is a graph illustrating a waveform which is applied to a cold-cathode fluorescence discharge tube in an illumination control device and an LM information display device according to the present invention.
Figure 17:
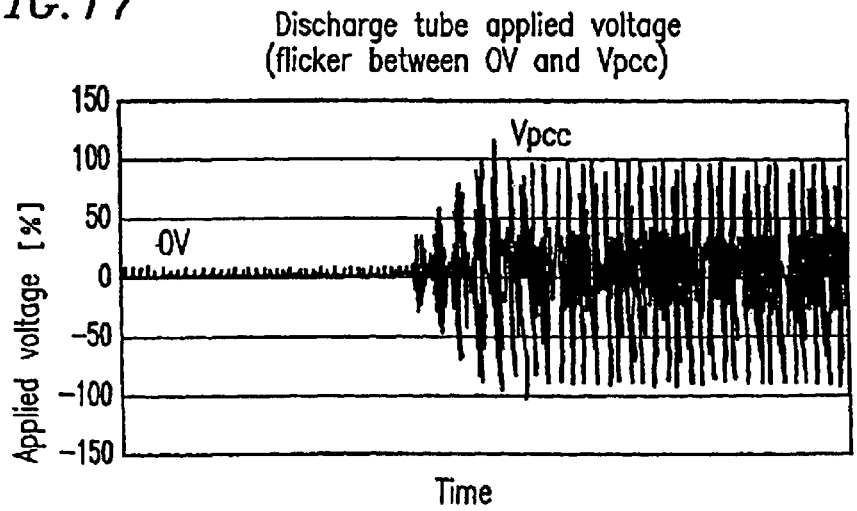
FIG. 17 is a graph illustrating a waveform which is applied to a fluorescence discharge tube in a conventional control method which repeats turning ON and OFF.

FIG. 16 shows a voltage waveform which is applied to the cold-cathode fluorescence discharge tube 1301 according to the present example. As a comparative example, FIG. 17 shows a voltage waveform which is applied to the fluorescence discharge tube in the case where ON/OFF of a conventional cold-cathode fluorescence discharge tube having two main discharging electrodes is controlled with a 60 Hz rectangular wave (transitioning between 0V and Vcc) being applied to the inverter circuit.

As seen from FIG. 16, in accordance with the illumination control device 1300 according to the present example of the invention, which employs a cold-cathode fluorescence discharge tube having a three-electrode structure with two main discharging electrodes 1301*x* and 1301*y* and one partial discharging electrode 1301*z*, an entirely-ON state occurs between the main discharging electrodes 1301*x* and 1301*y*; and a partially-ON or partial discharging state occurs between the main discharging electrode 1301*x* and the partial discharging electrode 1301*z*; this process is repeated. As a result, a discharge state is sustained even when the fluorescence discharge tube is flickered. Therefore, in accordance with the illumination control device 1300 of the present example of the invention, excessive voltage components are not generated at the beginning of the discharging as in the conventional cold-cathode fluorescence discharge tube shown in FIG. 17. Thus, the device life characteristics of the fluorescence discharge tube are improved.

EXAMPLE 4

Figure 14:
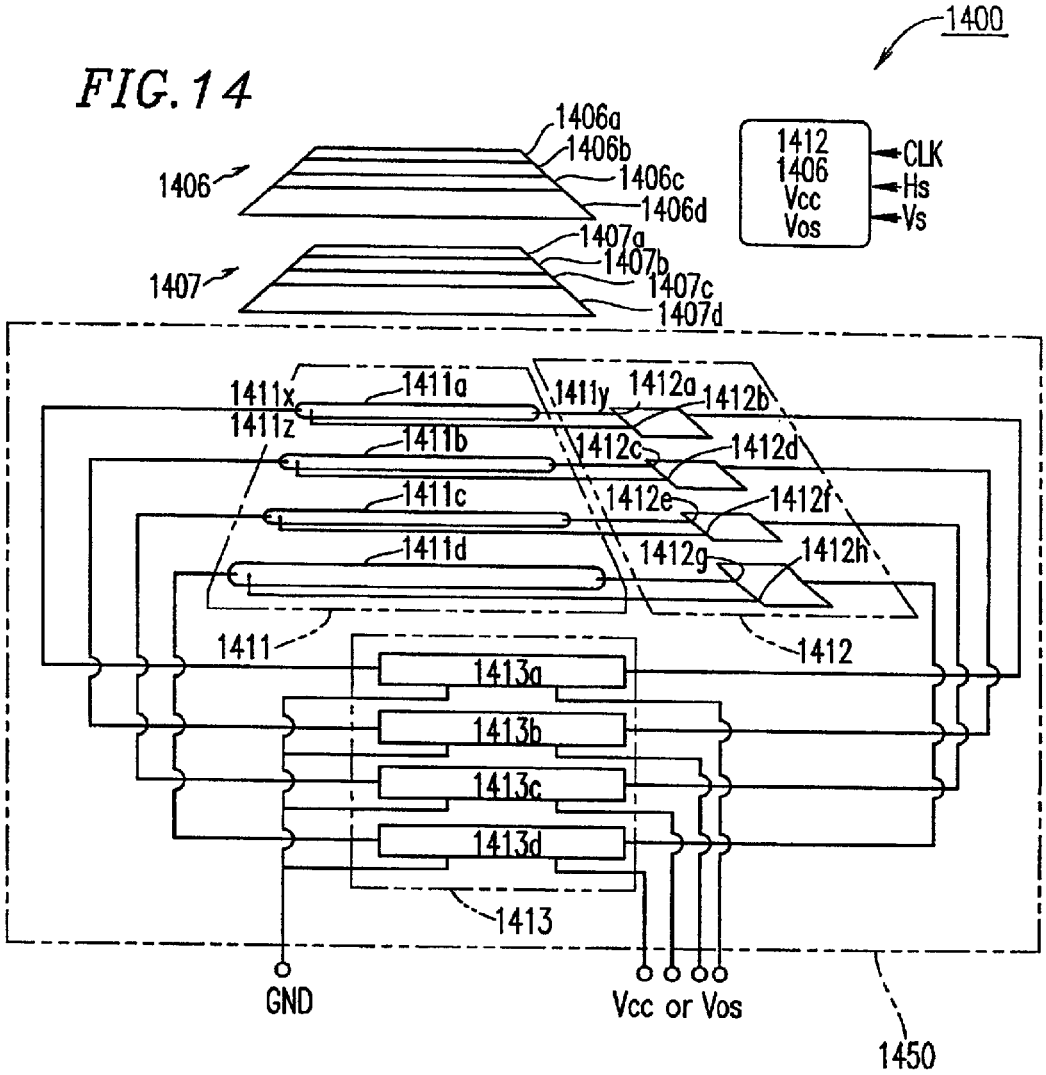
FIG. 14 is a schematic diagram illustrating an LM information display device according to Example 4 of the present invention.

FIG. 14 is a plan view schematically illustrating an LM information display device 1400 according to Example 4 of the present invention.

The LM information display device 1400 includes an LM information display section 1406, a light guide layer 1407 which is provided on a back face of the LM information display section 1406 for guiding illumination light into the LM information display section 1406, and an illumination control device (underlying-type backlight control device) 1450 which is disposed directly under the light guide layer 1407. The illumination control device 1450 includes illumination devices 1411.

In the present example, a liquid crystal panel incorporating TFTs as light-switching elements is employed as the LM information display section 1406. The number of pixels is: 640×480=(vertical lines)×(horizontal lines). A colorless plate of acrylic resin is used as the light guide layer 1407. As optical sheets, a diffusion sheet and a prism sheet 102*a* are provided on an outgoing end thereof. As the illumination device 1411, four cold-cathode fluorescence discharge tubes 1411*a*, 1411*b*, 1411*c*, and 1411*d* are employed.

Since four fluorescence discharge tubes 1411 are used in the illumination control device 1450 according to the present example, the electrode selection circuits 1412 include four output terminals 1412*a*, 1412*c*, 1412*e*, and 1412*g*, which serve as main discharging electrodes, and four output terminals 1412*b*, 1412*d*, 1412*f*, and 1412*h*, which serve as partial discharging electrodes. Thus, there is a total of eight electrodes employed.

A voltage which is output to the cold-cathode fluorescence discharge tube 1411*a* is the output from an inverter circuit 1413*a*; a voltage which is output to the cold-cathode fluorescence discharge tube 1411*b* is the output from an inverter circuit 1413*b*; the voltage which is output to the cold-cathode fluorescence discharge tube 1411*a* is the output from an inverter circuit 1413*c*; and the voltage which is output to the cold-cathode fluorescence discharge tube 1411*d* is the output from the inverter circuit 1413*d*.

During an entirely-ON period, an inverter driving voltage which is input to the inverter circuit 1413*a*, for example, is set to Vcc based on the clock signal (CLK), horizontal synchronizing signal (Hs), and the vertical synchronizing signal (Vs). In the electrode selection circuit 1412, the main discharging electrode terminal 1412*a* is coupled to the inverter circuit 1413*a*, and the cold-cathode fluorescence discharge tube 1411*a* is turned entirely-ON. Thus, while the cold-cathode fluorescence discharge tube 1411*a* is turned entirely-ON, the cold-cathode fluorescence discharge tubes 1401*b*, 1401*c*, and 1401*d* are in a non-entirely-ON period (i.e., a partially-ON period or a partial discharging period).

During a non-entirely-ON period (i.e., a partially-ON period or a partial discharging period), an inverter driving voltage which is input to the inverter circuit 1413*b*, for example, is set to Vos based on the clock signal (CLK), the horizontal synchronizing signal (Hs), and the vertical synchronizing signal (Vs). In the electrode selection circuit 1412, the main discharging electrode terminal 1412*d* is coupled to the inverter circuit 1413*b*, and the cold-cathode fluorescence discharge tube 1411*b* is turned partially-ON or caused to partially discharge.

Hereinafter, the operation of the LM information display device according to the present example will be described.

The LM information display section 1406 includes four split display regions 1406*a*, 1406*b*, 1406*c*, and 1406*d*. In the present example, the LM information display section 1406 includes 480 horizontal lines, so that each of the split display regions 1406*a* to 1406*d* includes 120 horizontal lines. Among the information displaying signals which are input to the LM information display section 1406, the horizontal synchronizing signal (Hs) and the vertical synchronizing signal (Vs) are used for determining the current scanning site for controlling the activation of the cold-cathode fluorescence discharge tubes 1411*a* to 1411*d* as appropriate.

In order to obtain light emission in the split activatable regions 1407*a* to 1407*d* of the light guide layer 1407 corresponding to the respective split display regions 1406*a* to 1406*d*, it is necessary to turn ON or OFF the respective cold-cathode fluorescence discharge tubes 1411*a* to 1411*d*.

First, after detecting 120 counts of the horizontal synchronizing signal (Hs), 640 counts of the vertical synchronizing signal (Vs) are detected to confirm that the scanning over the split display region 1406*a* has been completed. Thereafter, in order to cause the split activation region 1407*a* of the light guide layer 1407 to emit light, the immediately underlying cold-cathode fluorescence discharge tube 1411*a* is turned entirely-ON. At this time, the cold-cathode fluorescence discharge tubes 1411*b* to 1411*d* are turned partially-ON or caused to partially discharge (a non-entirely-ON period).

Accordingly, the output terminal 1412*a* of the electrode selection circuit 1412 is selected to be coupled to the inverter circuit 1413*a*. Since the voltage Vcc, which is a voltage value corresponding to entirely-ON periods is input to the inverter circuit 1413*a*, the cold-cathode fluorescence discharge tube 1411*a* is turned entirely-ON between the main discharging electrodes 1411*x* and 1411*y*. At this time, partial discharging electrode terminals 1412*d*, 1412*f* and 1412*h* are selected as outputs of the electrode selection circuit 1412*f* or the cold-cathode fluorescence discharge tubes 1411*b* to 1411*d*, but not the cold-cathode fluorescence discharge tube 1411*a*. Since the voltage Vos, which is a voltage value corresponding to the non-entirely-ON period (i.e., a partially-ON period or a partial discharging period) is input to the inverter circuits 1413*b* to 1413*d*, the cold-cathode fluorescence discharge tubes 1411*b* to 1411*d* are turned partially-ON or caused to partially discharge between the main discharging electrode 1411*x* and the partial discharging electrode 1411*z*.

Next, after detecting 240 counts of the horizontal synchronizing signal (Hs), 640 counts of the vertical synchronizing signal (Vs) are detected to confirm that the scanning over the split display region 1406*b* has been completed. Thereafter, in order to cause the split display region 1407*b* of the light guide layer 1407 to emit light, the immediately underlying cold-cathode fluorescence discharge tube 1411*b* is turned entirely-ON. At this time, the cold-cathode fluorescence discharge tubes 1411*a*, 1411*a*, and 1411*d* are turned partially-ON or caused to partially discharge (a non-entirely-ON period).

Thus, selected ones of the cold-cathode fluorescence discharge tubes 1411*a* to 1411*d* are sequentially turned entirely-ON.

Figure 18:
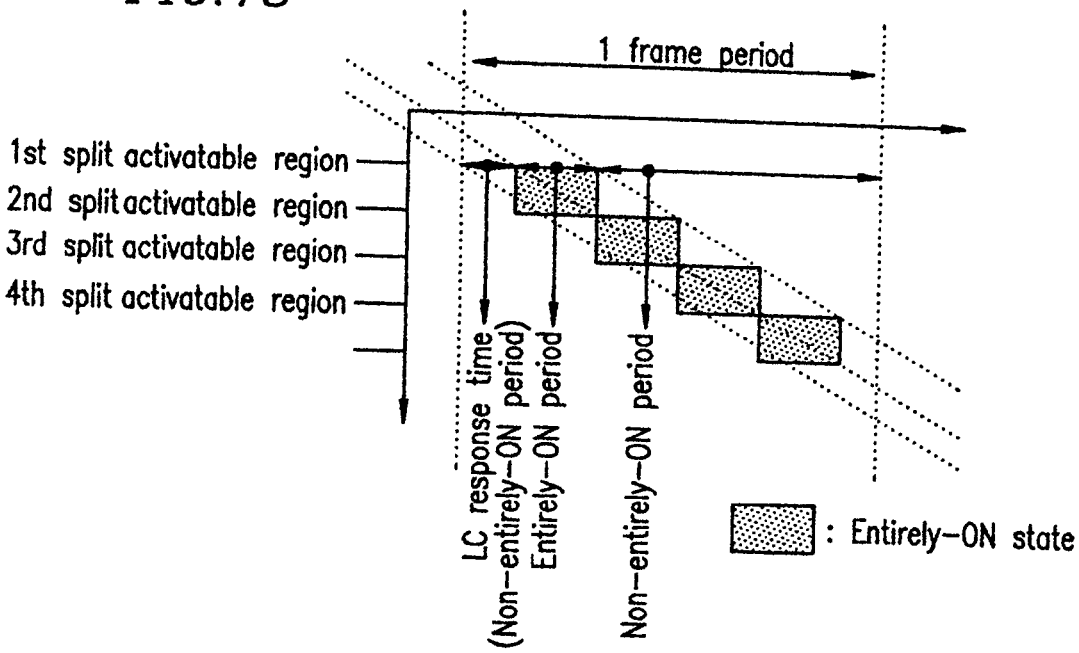
FIG. 18 is a timing diagram illustrating the fundamental operation principles of a split region scanning-type activation scheme in the LM information display device according to Example 4 of the present invention.

FIG. 18 shows a relationship between the entirely-ON periods and the non-entirely-ON periods (partially-ON periods or partial discharging periods) during 1 frame period, as well as the activation timing of the respective split activatable regions, according to the present example of the invention.

In FIG. 18, when a non-entirely-ON period transitions to an entirely-ON period, or when an entirely-ON period transitions to a non-entirely-ON period, the activation state is moved with a delay or gain in time corresponding to the response time of the light modulation material, thereby taking into account a delay corresponding to the response time of the liquid crystal material serving as a light modulation material.

Thus, it is possible to realize ON/OFF control with emission characteristics having steep rises or falls which are similar to those of an impulse-type emission system (e.g., CRTs). As a result, display blurs in line-of-sight tracing tests, such as those associated with the conventional always-ON scheme, can be alleviated.

Figure 19:
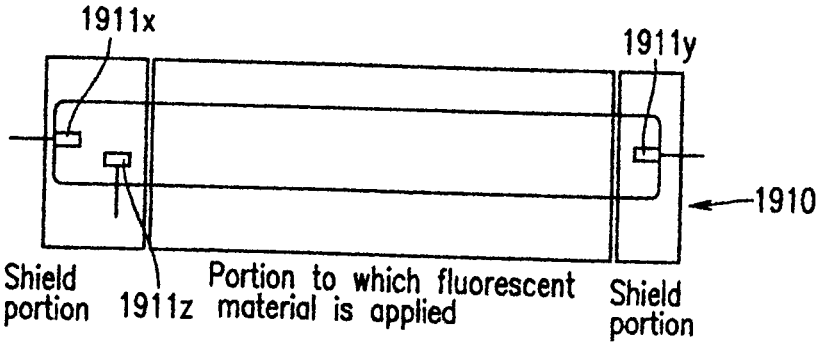
FIG. 19 is a view illustrating an exemplary structure of a cold-cathode fluorescence discharge tube according to an example of the present invention.
Figure 20:
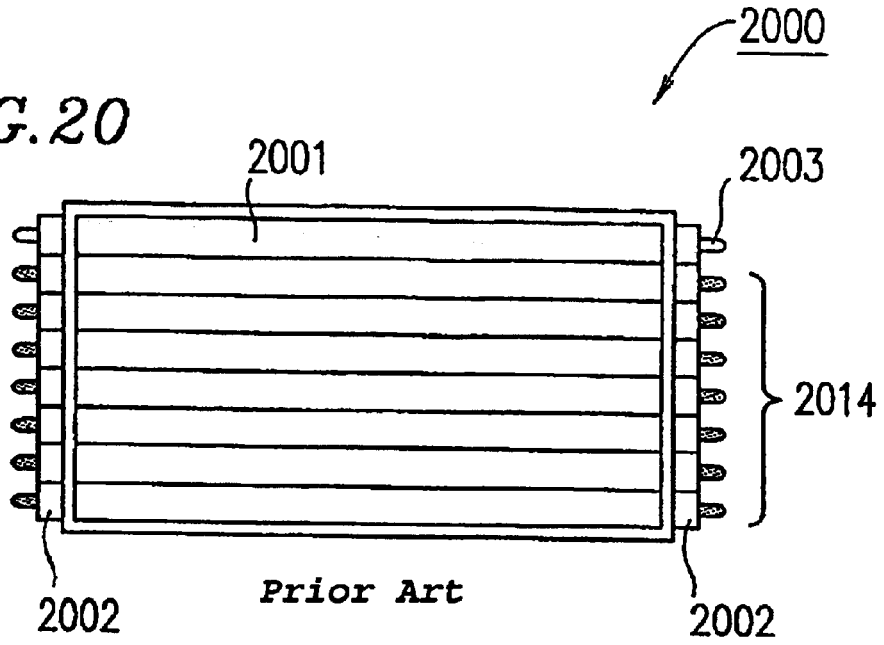
FIG. 20 is a plan view schematically illustrating a liquid crystal display device incorporating a conventional underlying-type backlight control device.
Figure 21:
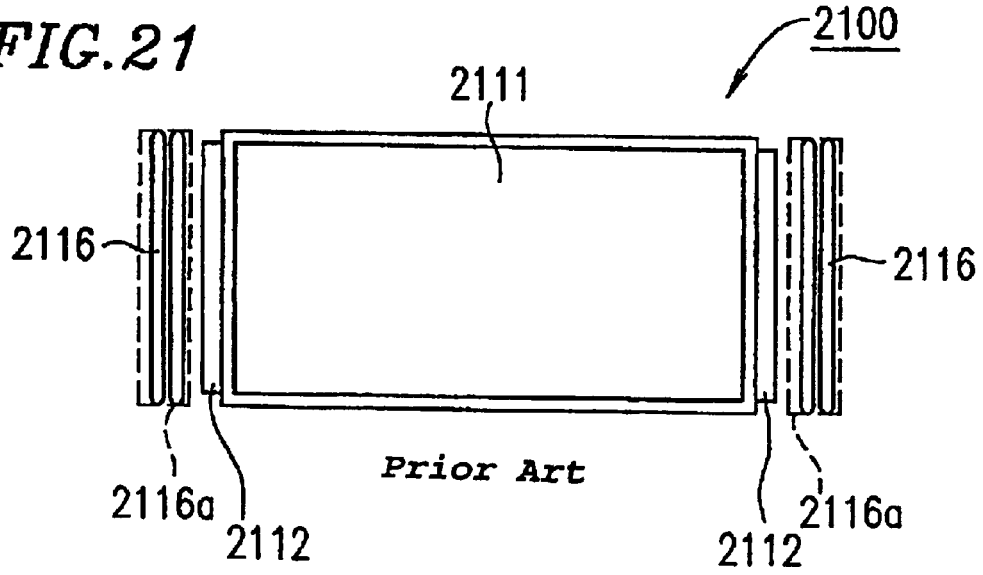
Prior Art FIG. 21
FIG. 21 is a plan view schematically illustrating a liquid crystal display device incorporating a conventional side-type backlight control device.
Figure 22A:
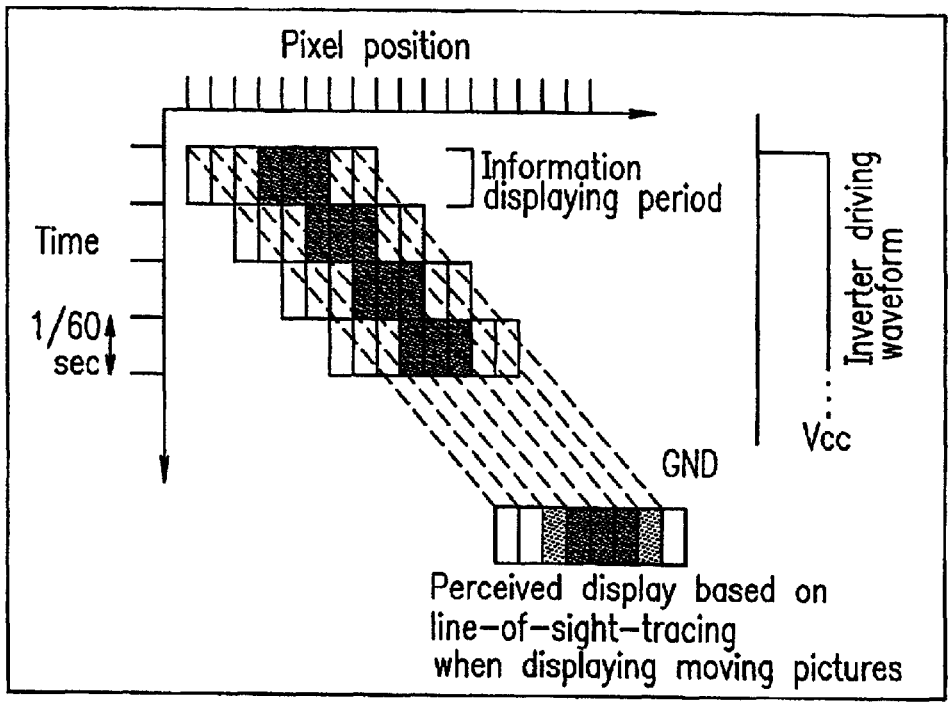
FIG. 22A is a graph showing results of line-of-sight tracing when moving pictures are displayed, with respect to a case where components within 1 frame period of the illumination device are ON periods only.
Figure 22B:
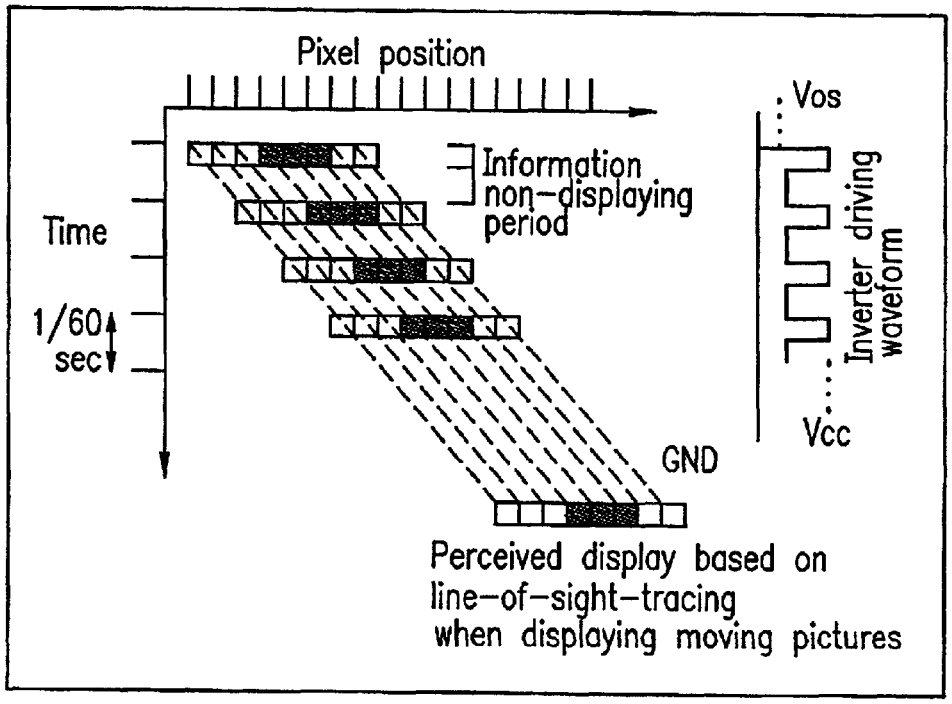
FIG. 22B is a graph showing results of line-of-sight tracing when moving pictures are displayed, with respect to a case where components within 1 frame period of the illumination device are ON periods and OFF periods.

A cold-cathode fluorescence discharge tube structure shown in FIG. 19 is employed in Examples 3 and 4 above. A fluorescent material does not need to be applied to the portion of the glass tube around a main discharging electrode 1911*x* and a partial discharging electrode 1911*z*. Alternatively, this portion may be coated with a shield layer so as to prevent ultraviolet rays from leaking outside the fluorescence discharge tube. In the latter case, even when a partially discharging voltage is applied between the main discharging electrode 1911*x* and the partial discharging electrode 1911*z*, the discharging between the main discharging electrode 1911*x* and the partial discharging electrode 1911*z* does not contribute to the fluorescence of the fluorescence discharge tube 1910. This state is referred to as a "partial discharge state".

Alternatively, a fluorescent material may be applied to the portion of the glass tube around the main discharging electrode 1911*x* and the partial discharging electrode 1911*z*. In this case, when a partially discharging voltage is applied between the main discharging electrode 1911*x* and the partial discharging electrode 1911*z*, this portion of the fluorescence discharge tube 1910 is turned ON. This state is referred to as a "partial-ON state".

The present invention is not limited to the above-described specific examples, but may assume various other configurations. For example, at least one illumination device needs to be provided for each split activatable region. Two or more fluorescence discharge tubes may be provided for each split activatable region. It is also possible to provide two or more split activatable regions corresponding to each split display region. Alternatively, one split activatable region may be provided corresponding to every two or more split display regions. Furthermore, a third electrode may be provided as a partial discharging electrode in the vicinity of either higher-voltage electrode among the two main discharging electrodes. The number of split regions is preferably in the following range: $1 \leqq$(number of split regions)$\leqq$(number of pixel lines along a horizontal direction). Given that fluorescence discharge tubes are employed as the illumination devices, the number of split display regions and the number of split activatable regions may both be about 10 to about 20 in order to obtain an appropriate luminance level, as described in the above examples. However, in the case where organic EL (electroluminescence) devices or the like are employed, the number of split display regions and the number of split activatable regions may both be increased up to the number of lines along the horizontal direction (which defines the maximum value).

Although a transmission LM information display device which displays information by variably controlling the manner in which light is transmitted therethrough has been described, the present invention is not limited thereto. The present invention is also applicable to any LM information display device in which an LM information display section variably controls at least one of the absorption, interception, reflection state, or reflection direction of light from an illumination control device.

Furthermore, although an underlying-type backlight control device in which a light guide layer is provided on a back face of an LM information display section and a fluorescence discharge tube(s) is provided directly under the light guide layer has been described, the present invention is also applicable to a side-type backlight control device in which a fluorescence discharge tube is provided at one end or both ends of a light guide layer, or a frontlight control device in which a light guide layer is provided on a front face of an LM information display section. In this case, the structure illustrated in Example 4 can be more suitably used than the structure illustrated in Example 3. In the case where a light valve composed of a reflection liquid crystal device is employed in a projection-type display device, which bears some similarities to the case of employing a frontlight configuration, the structure illustrated in Example 3 can also be suitably employed.

Specific examples of the LM information display device according to the present invention include, for example, a transmission liquid crystal display device, a reflection liquid crystal display device, a DMD, a mechanical shutter element, and the like.

As specifically described above, according to the present invention, the fluorescence discharge tubes serving as illumination devices are not completely turned OFF, so that the excessive voltage components which may be present at the beginning of the discharging can be reduced, and the number of electrons sputtered within the fluorescence discharge tube can be controlled, as compared to the conventional control method which repeats turning ON and OFF. Thus, device life characteristics similar to those obtained by a conventional light regulation (bright/dark) method can be realized according to the present invention.

Regarding the luminance characteristics, light leakage in each split activatable region is prevented during a non-entirely-ON period (i.e., a partially-ON state, a minimal discharging state, or a partial discharging state) of the fluorescence discharge tube(s) serving as an illumination device(s). Moreover, since image blurs (e.g., blurred outlines), and residual images are substantially prevented, an excellent display quality can be obtained as compared to that obtained with a conventional light regulation (bright/dark) method. During a partially-ON state, the light emitted from a portion of each fluorescence discharge tube which is turned partially-ON does not reach the light guide layer or the effective display area of the LM information display section. Since unwanted light does not stray into the non-displaying portions, moving pictures can be displayed with a high display quality.

Regarding the temperature characteristics, activation or discharging is always performed in a partially-ON, minimal discharging retention, or a partial discharging portion of each fluorescence discharge tube serving as an illumination device. Therefore, the difficulty in reaching an electrode temperature or an ambient temperature at which optimum discharging characteristics (i.e., maximum luminance) can be obtained, which is due to the unstable elevation of the electrode temperature as observed with the conventional control method which repeats turning ON and OFF, can be alleviated. Moreover, the present invention can minimize the decrease in luminance due to an excessive elevation of the electrode temperature or ambient temperature, which may occur when a number of fluorescence discharge tubes are provided at a high density as in the case of the conventional light regulation (bright/dark) method, where a temperature elevation of the fluorescence discharge tube electrodes, similar to that associated with the always-ON control method, may occur.

Regarding the power consumption characteristics, in the case where a 60 kHz rectangular wave is simply input to an inverter for controlling the ON/OFF of fluorescence discharge tubes serving as illumination devices, the LM information display device and the illumination control device according to the present invention can achieve about 50% reduction in power consumption (which is similar to the level of power consumption reduction obtained with the conventional control method which repeats turning ON and OFF), as opposed to an about 20% to 30% reduction in power consumption which is obtained with the conventional light regulation (bright/dark) method.

Thus, according to the present invention, an LM information display device can be realized which has an improved device life and reliability as well as optimum electrode temperature stability, and which realizes reduced power consumption and a high display quality for moving pictures.

According to the present invention, a three-electrode structure including two main discharging electrodes and one partial discharging electrode is adopted for the fluorescence discharge tube(s), such that an entirely-ON state occurs between the two main discharging electrodes during an entirely-ON period; and a partially-ON or partial discharging state occurs between one of the main discharging electrodes and the partial discharging electrode; this process is repeated. As a result, a discharge state is sustained even when the portion of the fluorescence discharge tube is flickered.

Therefore, excessive voltage components are not generated at the beginning of the discharging, whereby the device life characteristics of the fluorescence discharge tube can be improved.

Furthermore, when a non-entirely-ON period (a partially-ON period or a partial discharging period) transitions to an entirely-ON period, the activation state is moved with a delay corresponding to the response time of the light modulation material, thereby realizing emission characteristics having steep rises or falls which are similar to those of an impulse-type emission system (e.g., CRTs). As a result, display blurs in line-of-sight tracing tests, such as those associated with the conventional always-ON scheme, can be alleviated, and moving pictures can be displayed with a high display quality.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An illumination control device for illuminating a light modulation information display device with light, comprising:

at least one illumination device for irradiating light which is generated through discharging, the at least one illumination device having a first portion and a second portion; and a driving waveform generation section for controlling the light which is irradiated from the at least one illumination device to the light modulation information display device, wherein:

the light modulation information display device is operable so as to have a first period and a second period during which an image is displayed;

during the first period, the driving waveform generation section applies a first voltage to the second portion of the at least one illumination device, the first voltage causing the second portion of the at least one illumination device to be turned entirely-ON; and during the second period, the driving waveform generation section applies a second voltage to the first portion of the at least one illumination device wherein the second voltage is different from the first voltage and the second voltage is a partially-ON voltage for causing the first portion of the at least one illumination device to be illuminated such that the at least one illumination device sustains a discharging state.

2. An illumination control device according to claim 1, wherein the second voltage causes the at least one illumination device to have a minimal discharging.

3. An illumination control device according to claim 1, wherein the second voltage causes the at least one illumination device to retain a partial discharging.

4. An illumination control device according to claim 1, further comprising a light modulation information display section, wherein the modulation information display section controls light provided from the illumination control device to display information.

5. An illumination control device according to claim 4, wherein the controlling of the light comprises at least one of transmission, absorption, interception, reflection of the light.

6. An illumination control device as recited in claim 1, wherein the first portion is smaller than and within the second portion.

7. An illumination control device for illuminating a light modulation information display device with light, comprising:

at least one illumination device for irradiating light which is generated through discharging; and a driving waveform generation section for controlling the light which is irradiated from the at least one illumination device to the light modulation information display device by generating a repetitive waveform, wherein:

the light modulation information display device is operable so as to receive the repetitive waveform having a first period and a second period during which an image is displayed;

during the first period, the driving waveform generation section applies a first voltage to the at least one illumination device, the first voltage causing the at least one illumination device to be turned entirely-ON;

during the second period, the driving waveform generation section applies a second voltage to a portion of the at least one illumination device, wherein the second voltage is different from the first voltage; wherein:

each of the at least one illumination device comprises two main discharging electrodes and a partial discharging electrode provided in a vicinity of one of the two main discharging electrodes;

the driving waveform generation section applies the first voltage between the two main discharging electrodes during the first period;

the driving waveform generation section applies the second voltage between the partial discharging electrode and the one main discharging electrode in the vicinity of the partial discharging electrode during the second period; and an outer wall of the illumination device comprises at least one of a light shielding surface or an ultraviolet ray-shielding surface in a vicinity of the portion between the one main discharging electrode and the partial discharging electrode.

8. An illumination control device according to claim 7, wherein:

the at least one illumination device comprises a plurality of illumination devices; and for each of the plurality of illumination devices, the driving waveform generation section individually selects a voltage to be applied and electrodes between which a discharge is to occur, depending on the first period and the second period of the illumination device.

9. A light modulation information display device comprising:

a light modulation information display section; and an illumination control device comprising at least one illumination device having two main discharging electrodes and a partial discharging electrode, wherein light provided from the at least one illumination device is irradiated to the light modulation information display section, wherein:

the at least one illumination device has a length greater than a corresponding dimension of the light modulation information display section;

the at least one illumination device includes a first region corresponding to the light modulation information display section and a second region not corresponding to the light modulation information display section; and one of the two main discharging electrodes is disposed in the first region, and the other of the two main discharging electrodes and the partial discharging electrode are disposed in the second region, wherein the at least one illumination device undergoes an entirely-ON state between the two main discharging electrodes and a partially-ON state between the other of the two main discharging electrodes disposed in the second region and the partial discharging electrode such that during the partially-ON state, the at least one illumination device provides light that is outside the light modulation information display section.

10. A light modulation information display device according to claim 9, wherein the at least one illumination device retains a minimal discharging between the other of the two main discharging electrodes disposed in the second region and the partial discharging electrode.

11. A light modulation information display device according to claim 9, wherein the at least one illumination device retains a partial discharging between the other of the two main discharging electrodes disposed in the second region and the partial discharging electrode.

12. A light modulation information display device according to claim 9, wherein:

the light modulation information display section is split into a plurality of split display regions each containing a number of horizontal scanning lines;

at least one split activatable region is provided in the illumination control device so as to correspond to each of the plurality of split display regions, wherein at least one illumination device is assigned to each of the plurality of split activatable regions;

a voltage is applied between the two main discharging electrodes of at least one illumination device in at least one of the plurality of split activatable regions corresponding to at least one of the plurality of split display regions over which scanning of an image has progressed or completed; and a voltage is applied between the partial discharging electrode and the other of the two main discharging electrodes of at least one illumination device in at least one of the plurality of split activatable regions corresponding to at least one split display region over which scanning of the image has not been performed.

13. A light modulation information display device according to claim 9, wherein:

the light modulation information display device further includes a light modulation material;

the light modulation information display section is split into a plurality of split display regions each containing a number of horizontal scanning lines;

at least one split activatable region is provided in the illumination control device so as to correspond to each of the plurality of split display regions, wherein at least one illumination device is assigned to each of the plurality of split activatable regions;

after scanning of an image over at least one of the plurality of split display regions has progressed or completed, with a delay corresponding to a response time of the light modulation material, a voltage is applied between the two main discharging electrodes of at least one illumination device in at least one of the plurality of split activatable regions corresponding to the at least one split display region; and a voltage is applied between the partial discharging electrode and the other of the two main discharging electrodes of at least one illumination device in at least one of the plurality of split activatable regions corresponding to the split display regions over which scanning has not been performed.

14. A light modulation information display device according to claim 13, wherein the light modulation information display device further includes a light-switching element for controlling the light modulation information display section; and after the scanning has progressed or completed, with a delay corresponding to a response time of the light modulation material and a response time of the light-switching element, a voltage is applied between the two main discharging electrodes of at least one illumination device in the at least one split activatable region corresponding to the at least one split display region.

15. A light modulation information display device according to claim 13, wherein:

when a period during which the voltage is applied between the other of the two main discharging electrodes and the partial discharging electrode transitions to a period during which the voltage is applied between the two main discharging electrodes, a delay corresponding to a response time of the light modulation material is introduced in the split activatable region after scanning over an image has progressed or completed in the light modulation information display section.

16. A light modulation information display device according to claim 9, wherein:

based on an information displaying signal which is applied to the light modulation information display section during a 1 frame, a voltage is applied between the two main discharging electrodes of the at least one illumination device during an entirely-ON voltage period, a voltage is applied between the partial discharging electrode and the other of the two main discharging electrodes of the at least one illumination device during a partially-ON voltage period or a retention discharging voltage period.

* * * * *